US009505015B2

(12) United States Patent
Conway et al.

(10) Patent No.: US 9,505,015 B2
(45) Date of Patent: Nov. 29, 2016

(54) TRIGGER SPRAYER WITH BOTTLE FILLING CONDUIT

(71) Applicant: S.C. Johnson & Son, Inc., Racine, WI (US)

(72) Inventors: Simon M. Conway, Burlington, WI (US); Linda J. Babinski, Kenosha, WI (US); Kate Schreiber, Milwaukee, WI (US); Robert T. Wosewick, Shorewood, WI (US); Aaron B. Eiger, Chicago, IL (US); Evan P. Thompson, Oak Park, IL (US); Trevor Wesolowski, Chicago, IL (US)

(73) Assignee: S. C. Johnson & Son, Inc., Racine, WI (US)

( * ) Notice: Subject to any disclaimer, the term of this patent is extended or adjusted under 35 U.S.C. 154(b) by 52 days.

(21) Appl. No.: 14/282,120

(22) Filed: May 20, 2014

(65) Prior Publication Data

US 2014/0346193 A1 Nov. 27, 2014

Related U.S. Application Data

(60) Provisional application No. 61/825,856, filed on May 21, 2013, provisional application No. 61/905,078, filed on Nov. 15, 2013.

(51) Int. Cl.
*B67D 7/84* (2010.01)
*B05B 11/00* (2006.01)
(Continued)

(52) U.S. Cl.
CPC ..... *B05B 11/3011* (2013.01); *A45F 5/021* (2013.01); *B05B 11/007* (2013.01);
(Continued)

(58) Field of Classification Search
CPC ..... B05B 11/0037; B05B 11/001; B05B 11/0008; B05B 11/3043; B05B 15/061; B05B 15/06; B05B 11/3011; B05B 11/007; B05B 11/0097; B05B 11/3045; A45F 5/021; A45F 2200/0583
USPC ..... 222/173
See application file for complete search history.

(56) References Cited

U.S. PATENT DOCUMENTS 3,160,304 A 12/1964 Peacock
3,228,567 A 1/1966 Abplanalp
(Continued)

FOREIGN PATENT DOCUMENTS

DE 2601713 A1 7/1977
DE 8912131 U1 1/1990
(Continued)

OTHER PUBLICATIONS

PCT/US2014/038881 International Search Report and Written Opinion dated Dec. 12, 2014.
(Continued)

*Primary Examiner* — Patrick M Buechner

(57) ABSTRACT

A fluid delivery device having a trigger actuated sprayer assembly for dispensing a liquid with features such as a bottle with a concavity, a clip around the bottle neck, a sprayer assembly with a bottle filling conduit and a translucent neck window on the sprayer assembly for viewing the bottle filling conduit. The fluid delivery system includes a bottle with a concavity in the side wall attached to a body. A pump in the body receives fluid from the bottle via a fluid inlet conduit and discharges the fluid from a fluid discharge conduit. Also provided is a kit including (i) a fluid delivery device with a bottle, and (ii) one or more fluid refill containers, wherein the bottle and the container(s) include matching indicia of the fluid such that the bottle is only filled from a container with the fluid indicated by the matching indicia.

15 Claims, 22 Drawing Sheets

(51) Int. Cl.
*B05B 15/06* (2006.01)
*A45F 5/02* (2006.01)

(52) U.S. Cl.
CPC ..... *B05B11/0037* (2013.01); *B05B 11/0097* (2013.01); *B05B 11/3045* (2013.01); *B05B 15/061* (2013.01); *A45F 2200/0583* (2013.01); *B05B 11/001* (2013.01)

(56) References Cited

U.S. PATENT DOCUMENTS

| | | | | |
|---|---|---|---|---|
| 3,450,313 | A | 6/1969 | Jonas | |
| 3,599,684 | A | 8/1971 | Elias | |
| 4,275,820 | A | 6/1981 | LeBlond | |
| 4,570,823 | A | 2/1986 | Arabian et al. | |
| 4,618,076 | A | 10/1986 | Silvenis | |
| 4,781,311 | A * | 11/1988 | Dunning | B05B 11/001 215/318 |
| 4,832,230 | A | 5/1989 | Janowitz | |
| 5,215,227 | A | 6/1993 | Farner | |
| 5,238,152 | A * | 8/1993 | Maas | B05B 11/3011 215/274 |
| 5,628,432 | A | 5/1997 | Mosley | |
| 5,704,521 | A | 1/1998 | Grogan et al. | |
| 5,740,948 | A | 4/1998 | Chu et al. | |
| 5,878,917 | A | 3/1999 | Reinhard et al. | |
| 5,950,879 | A | 9/1999 | Ritsche | |
| 6,032,814 | A | 3/2000 | Foster | |
| 6,155,462 | A * | 12/2000 | Brecheisen | B05B 11/001 215/276 |
| D435,792 | S | 1/2001 | Peloquin | |
| 6,179,125 | B1 | 1/2001 | Kvitrud et al. | |
| D450,592 | S | 11/2001 | Guseo | |
| 6,319,453 | B1 | 11/2001 | Klima, Jr. et al. | |
| 6,345,738 | B1 | 2/2002 | Brozell et al. | |
| 6,398,132 | B1 | 6/2002 | Junkel et al. | |
| 6,412,523 | B2 | 7/2002 | Brozell et al. | |
| D462,608 | S | 9/2002 | Sweeton | |
| D468,194 | S | 1/2003 | Siebert et al. | |
| 6,540,119 | B1 * | 4/2003 | Bensussan | A45F 5/02 222/192 |
| 6,595,246 | B2 | 7/2003 | Brozell et al. | |
| 6,776,039 | B1 | 8/2004 | Lu et al. | |
| 6,793,075 | B1 | 9/2004 | Jeter | |
| 6,793,094 | B2 | 9/2004 | Turnbough | |
| 6,981,658 | B2 | 1/2006 | Streutker et al. | |
| 6,988,629 | B2 | 1/2006 | Pedmo et al. | |
| D516,435 | S | 3/2006 | Barraclough | |
| D519,371 | S | 4/2006 | Hornsby et al. | |
| 7,032,841 | B1 | 4/2006 | Swisher | |
| D519,836 | S | 5/2006 | Swisher | |
| 7,047,601 | B1 | 5/2006 | Vernon-Woods | |
| 7,178,696 | B2 | 2/2007 | Larsen et al. | |
| D557,143 | S | 12/2007 | Batliner | |
| 7,303,150 | B2 | 12/2007 | Hildebrand | |
| 7,316,332 | B2 | 1/2008 | Powers et al. | |
| D573,467 | S | 7/2008 | Dell'Orto | |
| D581,805 | S | 12/2008 | Suxdorf | |
| D583,677 | S | 12/2008 | Harrison et al. | |
| D584,617 | S | 1/2009 | Harrison et al. | |
| D590,721 | S | 4/2009 | Martinez De San Vicente | |
| D601,897 | S | 10/2009 | Contiero | |
| D614,957 | S | 5/2010 | Schaeffer | |
| 7,757,906 | B2 | 7/2010 | Barry | |
| 7,775,401 | B2 | 8/2010 | Banco et al. | |
| D624,434 | S | 9/2010 | Schaeffer et al. | |
| D626,845 | S | 11/2010 | De Haan | |
| 7,954,666 | B2 | 6/2011 | Webster et al. | |
| D642,923 | S | 8/2011 | Newton | |
| D653,110 | S | 1/2012 | Sweeton | |
| D653,540 | S | 2/2012 | Sweeton | |
| D653,541 | S | 2/2012 | Foster et al. | |
| D654,371 | S | 2/2012 | Geeraert et al. | |
| D655,163 | S | 3/2012 | Keny et al. | |
| 8,136,690 | B2 | 3/2012 | Fang et al. | |
| D664,431 | S | 7/2012 | Wang | |
| D669,364 | S | 10/2012 | Schaeffer et al. | |
| 8,322,576 | B2 | 12/2012 | Gioia | |
| 2002/0020720 | A1 | 2/2002 | Schmid et al. | |
| 2003/0141330 | A1 * | 7/2003 | McDonald | A45F 5/02 224/242 |
| 2003/0234263 | A1 * | 12/2003 | Kondoh | B05B 11/001 222/321.9 |
| 2004/0020950 | A1 * | 2/2004 | Overbay | A45F 3/18 224/148.7 |
| 2004/0149877 | A1 * | 8/2004 | Herrmann | B05B 15/061 248/312 |
| 2008/0047977 | A1 | 2/2008 | Larsen et al. | |
| 2008/0257913 | A1 * | 10/2008 | Contiero | B05B 11/001 222/383.1 |
| 2008/0302827 | A1 | 12/2008 | Gerrish et al. | |
| 2010/0089950 | A1 * | 4/2010 | Helf | B65D 83/206 222/153.09 |
| 2010/0096414 | A1 | 4/2010 | Dennis | |
| 2010/0108857 | A1 | 5/2010 | Andrae | |
| 2012/0218106 | A1 | 8/2012 | Zaima et al. | |
| 2012/0234871 | A1 | 9/2012 | Good et al. | |
| 2012/0234872 | A1 | 9/2012 | Good et al. | |
| 2013/0037572 | A1 | 2/2013 | Yapaola et al. | |
| 2014/0346193 | A1 * | 11/2014 | Conway | B05B 11/3011 222/173 |

FOREIGN PATENT DOCUMENTS

| | | | |
|---|---|---|---|
| EP | 0170980 | A2 | 2/1986 |
| EP | 0347957 | A2 | 12/1989 |
| EP | 0674948 | A1 | 10/1995 |
| EP | 1134030 | A2 | 9/2001 |
| EP | 1407825 | A1 | 4/2004 |
| FR | 2545382 | A1 | 11/1984 |
| GB | 2310149 | A | 8/1997 |
| GB | 2456230 | A | 7/2009 |
| JP | 11019551 | A | 1/1999 |
| NL | 1011479 | C2 | 4/2002 |
| WO | 2008133687 | A1 | 11/2008 |

OTHER PUBLICATIONS

Product Information: Genuine US Military Issue 1 Quart, 3 Piece Plastic Canteen, NSN 8465-00-889-3744, www.bestglide.com/military_canteen.html, accessed Feb. 5, 2013, 2 pages.

* cited by examiner

TRIGGER SPRAYER WITH BOTTLE FILLING CONDUIT

CROSS-REFERENCES TO RELATED APPLICATIONS

This application claims priority from U.S. Provisional Patent Application No. 61/825,856 filed May 21, 2013 and U.S. Provisional Patent Application No. 61/905,078 filed Nov. 15, 2013.

STATEMENT REGARDING FEDERALLY SPONSORED RESEARCH

Not Applicable.

BACKGROUND OF THE INVENTION

1. Field of the Invention

This invention relates to a fluid delivery device having a trigger actuated sprayer assembly for dispensing a liquid from a bottle, and particularly to a fluid delivery device having a bottle with concavity, and/or a clip around the bottle neck, and/or a sprayer assembly with a bottle filling conduit, and/or a translucent viewing area on the sprayer assembly for viewing the bottle filling conduit. This invention also relates to a kit including a fluid delivery device and one or more fluid refill containers. This invention also relates to a method for dispensing a fluid from a trigger sprayer wherein the method uses a bottle and a container including matching indicia of the fluid to be dispensed such that the bottle is only filled from the container with the fluid indicated by the matching indicia.

2. Description of the Related Art

It is often desirable to have a trigger operated sprayer which is reusable, easily transported, convenient and comfortable. For example, a reusable trigger sprayer can be refilled with the same fluid after the contents of the sprayer have been depleted. Alternatively, it is often desirable to add one or more additional fluids such as a concentrated fluid to a first fluid already contained in the sprayer. In other situations, there may be a need for a sprayer device to be emptied of a first fluid and filled with a second fluid. In the aforementioned instances, it is desirable to view the liquid level in the trigger sprayer when filling or refilling the bottle. In addition, a convenient and easily transported trigger sprayer can be worn on one's person, for example, through the use of a clip, such that the trigger sprayer is always within reach. In this instance, it is desirable that the trigger sprayer is comfortable and ergonomically designed when worn.

There are examples in the art of trigger sprayers which are refillable and reusable. U.S. Pat. No. 4,618,076 describes a trigger sprayer wherein the trigger dispensing mechanism may be attached to a bottle having a threaded fitment by a threaded connection. U.S. Pat. No. 5,337,921 describes an alternative method of attaching a trigger sprayer to a bottle or pouch wherein the sprayer cap is secured to the pouch neck by a 'bayonet-type' coupling. The disclosures of these patents and of all other publications referred to herein are incorporated by reference as if fully set forth herein.

It has been recognized in the art that dispensers such as those in U.S. Pat. Nos. 4,618,076 and 5,337,921 do have disadvantages when attempting to reuse or refill the container attached to the trigger sprayer mechanism. Often, a mess or spill is unavoidable when detaching the sprayer from the bottle. For example, many trigger sprayers include a dip tube in contact with the fluid in the container. When the dip tube is removed to facilitate the refill process, it can come into contact with the user of the sprayer or objects in the vicinity. Additionally, it is not always possible to view the liquid level in the container to avoid overfilling. Furthermore, these dispensers do not prevent a user from filling the bottle with a refill chemical that is not suitable for the intended use of the dispenser. For instance, a dispenser intended for a window cleaning application could be refilled with a chemical not suitable for window cleaning.

U.S. Pat. No. 6,345,738 recites a method for filling a trigger sprayer device without removing the trigger mechanism from the container wherein the pump body includes a rearward vertical container fill conduit. However, while the fill conduit in U.S. Pat. No. 6,345,738 allows a fluid to be passed directly through the pump body into the container without removing the pump body from the container, once the fill conduit is closed, it is permanently sealed. U.S. Pat. No. 4,618,076 discloses a dual dispensing trigger sprayer device wherein the trigger sprayer body includes a second, reversibly sealable conduit for dispensing a large amount of product without detaching the trigger sprayer mechanism from the bottle. The device of U.S. Pat. No. 4,618,076 may not, however, be refilled through the second conduit.

Means that address trigger sprayer comfort and transportability are also known in the art. For example, U.S. Pat. Nos. 3,450,313 and 5,215,227 recite a clip which is attached to a sprayer device to aid in both aiming the sprayer and attaching the sprayer to an item of clothing such as a pocket or a belt. However, these sprayer devices are not ergonomically shaped to provide comfort to the user when worn. An alternative example of a clip is recited in U.S. Pat. No. 7,047,601, which describes a spray applicator belt hook for use in conjunction with spray applicator bottles. This hook does not attach to a trigger sprayer, but can be used to support the trigger sprayer beneath the trigger or other suitable structure which is part of the sprayer device.

Therefore, what is needed is an improved trigger sprayer for dispensing a liquid from a bottle.

SUMMARY OF THE INVENTION

The present invention provides a fluid delivery system which allows a user to reuse and refill the system through a filling conduit in the body of the trigger sprayer. A viewing area in the body allows the user to view the liquid level in the system, and a clip provides a means for transporting the sprayer while attached to, for example, a pocket or a belt or vest holster. Finally, a concavity in the bottle of the system has an ergonomic design in order that the system may be worn comfortably. The invention also provides a kit including a fluid delivery device and one or more fluid refill containers. In a method for using the kit, a bottle of the fluid delivery device and a container include matching indicia of the fluid to be dispensed such that the user is able to only fill the bottle from a container with the fluid indicated by the matching indicia of the bottle and the container.

The present invention provides a fluid delivery device including a bottle for containing a fluid. The bottle has an end wall and a side wall extending away from the end wall. The side wall terminates at an opening of the bottle. The fluid delivery device also includes a body attached to the bottle adjacent the opening of the bottle and a pump in the body, which is in fluid communication with a fluid inlet conduit upstream of the pump and a fluid discharge conduit downstream of the pump. The pump receives fluid from the fluid inlet conduit and discharges fluid from the fluid discharge conduit. Furthermore, the side wall of the bottle has a concavity that extends from the end wall of the bottle in a direction toward the opening of the bottle.

In one version of the fluid delivery device, a view of a cross-section of the side wall of the bottle transverse to a longitudinal axis of the bottle includes the concavity.

In another version of the fluid delivery device, the concavity extends from the end wall of the bottle to a neck region of the side wall of the bottle adjacent the opening of the bottle. The neck region of the side wall is of reduced diameter compared to an end wall region of the side wall of the bottle adjacent the end wall of the bottle.

In yet another version of the device, the fluid discharge conduit extends in a direction transverse to a radius of curvature of the concavity.

In still another version of the device, the body is attached to the bottle by way of a quarter turn bayonet fitting.

In yet another version of the device, the body is attached to the bottle by way of a quarter turn bayonet fitting and at least one mounting tab on the clip.

In still another version of the device, the bayonet fitting is secured in a bayonet channel of the body.

In yet another version of the device, the fluid delivery device further includes one of (i) an additional bayonet fitting or (ii) an additional bayonet channel such that the body can be attached to the bottle with the concavity facing leftward or rightward from the body when viewed from a rear view of the body.

It is therefore an advantage of the invention to provide an ergonomic concavity in the bottle of the present invention so that the fluid delivery device may be used and worn comfortably by a left handed user or a right handed user.

In another aspect, the invention provides a fluid delivery device which includes a bottle for containing a fluid. The bottle has an end wall and a side wall extending away from the end wall. The side wall terminates at an opening of the bottle and the bottle has a concavity that extends less than an entire perimeter of the side wall of the bottle. The body is attached to the bottle adjacent the opening of the bottle. A pump in the body is in fluid communication with a fluid inlet conduit upstream of the pump and a fluid discharge conduit downstream of the pump. The pump receives a fluid from the fluid inlet conduit and discharges a fluid from the fluid discharge conduit. A clip is secured to the bottle and arranged in facing relationship with the concavity in the side wall of the bottle.

In another version of the fluid delivery device, a view of a cross-section of the side wall of the bottle transverse to a longitudinal axis of the bottle includes the concavity.

In yet another version of the device, the concavity extends from the end wall of the bottle in a direction toward the opening of the bottle.

In one aspect of the present invention, the concavity extends from the end wall of the bottle to a neck region of the side wall of the bottle adjacent the opening of the bottle where the neck region of the side wall is of reduced diameter compared to an end wall region of the side wall of the bottle adjacent the end wall of the bottle.

It is therefore an advantage of the invention to provide an ergonomic concavity in the bottle and a clip so that the fluid delivery device may be worn comfortably by the user on an item of clothing such as a pocket or a belt.

In yet another aspect, the invention provides a fluid delivery device which includes a bottle for containing a fluid, the bottle having a neck adjacent an opening of the bottle, a body attached to the bottle, a pump in the body, and a clip having a collar dimensioned to surround the neck of the bottle. The pump in the body is in fluid communication with a fluid inlet conduit upstream of the pump and a fluid discharge conduit downstream of the pump. The pump can receive a fluid from the fluid inlet conduit and discharge a fluid from the fluid discharge conduit.

In one version of the fluid delivery device, the collar contacts a lower end of the body when the body is attached to the bottle.

In another version, the outer surfaces of the collar and the lower end of the body are flush when the body is attached to the bottle.

In one aspect, the clip includes an inverted J-shaped section integral with the collar.

In yet another version of the device, the body is attached to the bottle by way of a quarter turn bayonet fitting and at least one mounting tab on the clip.

It is therefore an advantage of the invention to provide a reversibly detachable clip which allows the user to wear the bottle on an item of clothing such as a pocket or a belt. Furthermore, the clip can be removed if it is desired by the user.

In another aspect, the invention provides a fluid delivery device which includes a pump in a body, which is in fluid communication with a fluid inlet conduit upstream of the pump and a fluid discharge conduit downstream of the pump in order to receive fluid from the fluid inlet conduit and discharge fluid from the fluid discharge conduit. A fluid filling conduit separate from the fluid discharge conduit and the fluid inlet conduit is in fluid communication with an opening in a wall of the body and an outlet of the body, wherein the wall of the body includes a translucent section that provides a view of an interior space of the fluid filling conduit.

In still another aspect of the fluid delivery device, the body includes a tubular part below the pump, and the tubular part of the body comprises a translucent section.

In a further aspect of the fluid delivery device the translucent section is transparent.

In another aspect of the fluid delivery device, a bottle for containing a fluid is attached to the body.

It is therefore an advantage of the invention to provide a translucent or transparent viewing area through which the fluid level in the bottle of the fluid delivery device can be monitored such as during the process of filling the bottle through the fluid refill conduit.

In another aspect, the invention provides a fluid delivery device comprising: a pump in a body, the pump being in fluid communication with a fluid inlet conduit upstream of the pump and a fluid discharge conduit downstream of the pump, the pump receiving fluid from the fluid inlet conduit and discharging fluid from the fluid discharge conduit; and a fluid filling conduit separate from the fluid discharge conduit and the fluid inlet conduit, the fluid filling conduit being in fluid communication with an opening in an outer wall of the body and an outlet of the body, wherein the fluid filling conduit has a first section having a first transverse area with a first diameter, a second section having a second transverse area with a second diameter, and an intermediate section joining the first section and the second section, the intermediate section having a third transverse area with a third diameter smaller than at least one of the first diameter and the second diameter.

In one version of the fluid delivery device, the third diameter smaller than the first diameter and the second diameter.

In one version of the fluid delivery device, the third transverse area is generally arcuate.

In one version of the fluid delivery device, a resealable lid is provided for closing off the opening.

In one version of the fluid delivery device, the first section overhangs a wall of the body defining the second section.

It is therefore an advantage of the invention to provide a fluid delivery device with an improved fluid filling conduit.

In another aspect, the invention provides a kit comprising a fluid delivery device and a container. The fluid delivery device comprises (i) a bottle for containing a fluid; (ii) a body attached to the bottle adjacent the opening of the bottle; and (iii) a pump in the body, the pump being in fluid communication with a fluid inlet conduit upstream of the pump and a fluid discharge conduit downstream of the pump, the fluid inlet conduit being in fluid communication with an interior space of the bottle, and the pump receiving fluid from the fluid inlet conduit and discharging fluid from the fluid discharge conduit. The container is suitable for holding the fluid or a chemical that can be diluted to prepare the fluid. The bottle and the container each include matching indicia of the fluid.

In one version of the kit, the matching indicia comprise a first indicator of a first color and a second indicator of the first color.

In yet another version of the kit, the matching indicia comprise a first indicator having a first symbol and a second indicator having the first symbol. The first symbol can include a letter, or a number, or any combination thereof.

In still another version of the kit, the first indicator is a first label and the second indicator is a second label.

In yet another version of the kit, the container contains a chemical that can be diluted to prepare the fluid. The bottle may be of greater volume than the container.

In still another version of the kit, the container contains the fluid. The bottle may be of lesser volume than the container.

In yet another version of the kit, the kit includes a plurality of the container.

It is therefore an advantage of the invention to provide a kit including a fluid delivery device having a bottle for containing a fluid and a container suitable for holding the fluid or a chemical that can be diluted to prepare the fluid, wherein the bottle and the container include matching indicia of the fluid such that the bottle is only filled from the container with the fluid indicated by the matching indicia.

In another aspect, the invention provides a method for dispensing a fluid. The method uses a fluid delivery device having a bottle for containing the fluid. The fluid delivery device bears a first indicia of the fluid that is contained in the bottle. A user selects a container that holds the fluid or a chemical that can be diluted to prepare the fluid by matching a second indicia on the container with the first indicia of the fluid delivery device. The bottle is then filled from the container.

In one version of the method, the first indicia comprises a first indicator of a first color, and the second indicia comprises a second indicator of the first color.

In one version of the method, the first indicia comprises a first indicator having a first symbol, and the second indicia comprises a second indicator having the first symbol. In one version of the method, the first symbol includes a letter. In one version of the method, the first symbol includes a number.

In one version of the method, the container contains a chemical that can be diluted to prepare the fluid.

In one version of the method, the bottle is of greater volume than the container.

In one version of the method, the bottle is of lesser volume than the container.

It is therefore an advantage of the invention to provide a method for dispensing a fluid in which a bottle and a container include matching indicia of the fluid to be dispensed such that the bottle is only filled from the container with the fluid indicated by the matching indicia.

These and other features, aspects, and advantages of the present invention will become better understood upon consideration of the following detailed description, drawings and appended claims.

BRIEF DESCRIPTION OF THE DRAWINGS

Like reference numerals will be used to refer to like parts from Figure to Figure in the following description of the drawings.

DETAILED DESCRIPTION OF THE INVENTION

Figure 1:
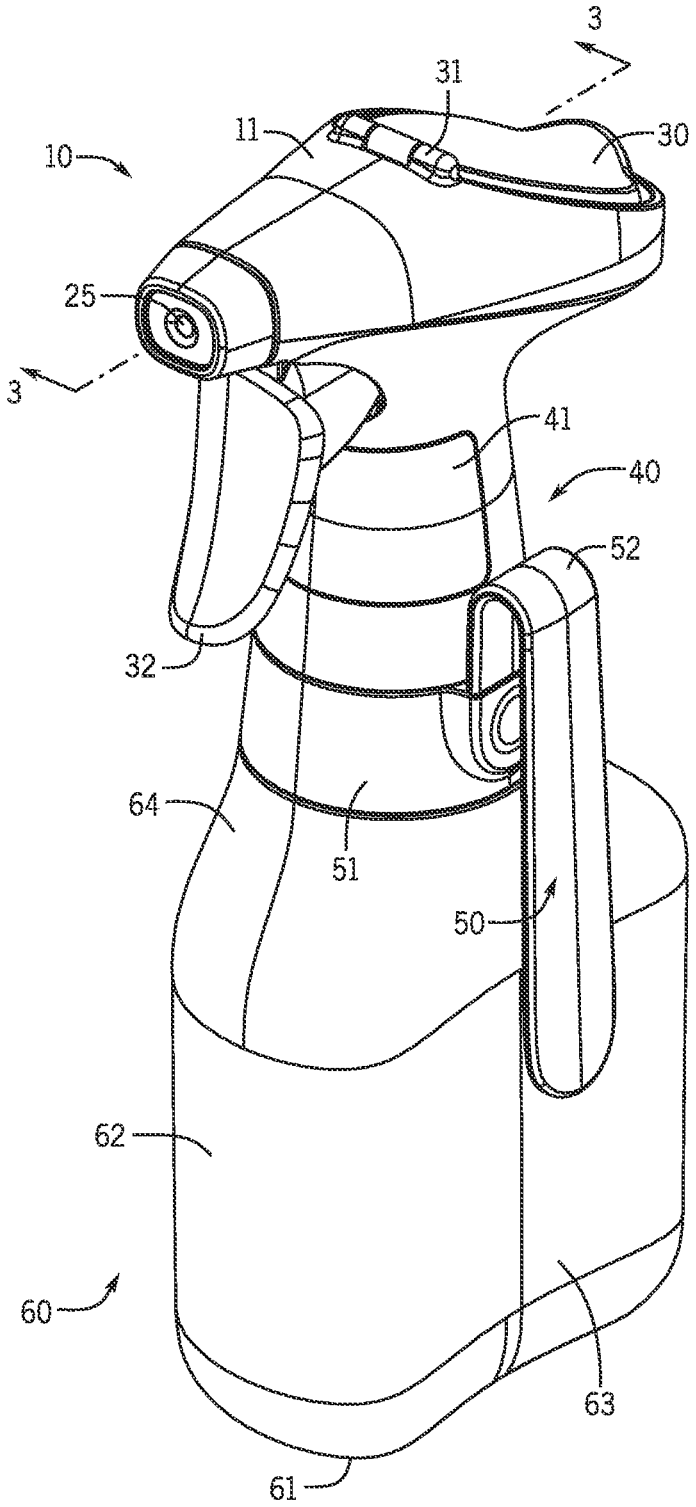
FIG. 1 is a perspective view of a first embodiment of a trigger sprayer with a bottle filling conduit.

Turning now to the FIGS. 1-10, FIG. 1 shows a perspective view of a first example embodiment of a fluid delivery device 8. The device 8 includes a trigger actuated sprayer assembly 10 above a bottle 60, and a clip 50 around the neck 67 of the bottle 60, wherein the neck 67 of the bottle 60 can be seen in FIG. 2. Upon further inspection of FIG. 1, it can be seen that the sprayer assembly includes a body 11 with a fluid discharge orifice 25 and a resealable lid 30 that operates on a lid hinge 31. The sprayer assembly 10 also has a finger trigger 32 to control dispensing of the liquid and a tubular part 40 which contains a translucent neck window 41.

The tubular part 40 is adjacent a clip 50 which includes a collar 51 and an inverted J-shaped section 52 of the clip 50 which is integral with the collar 51. The collar is disposed between the tubular part 40 of the sprayer assembly 10 and the bottle 60.

Figure 2:
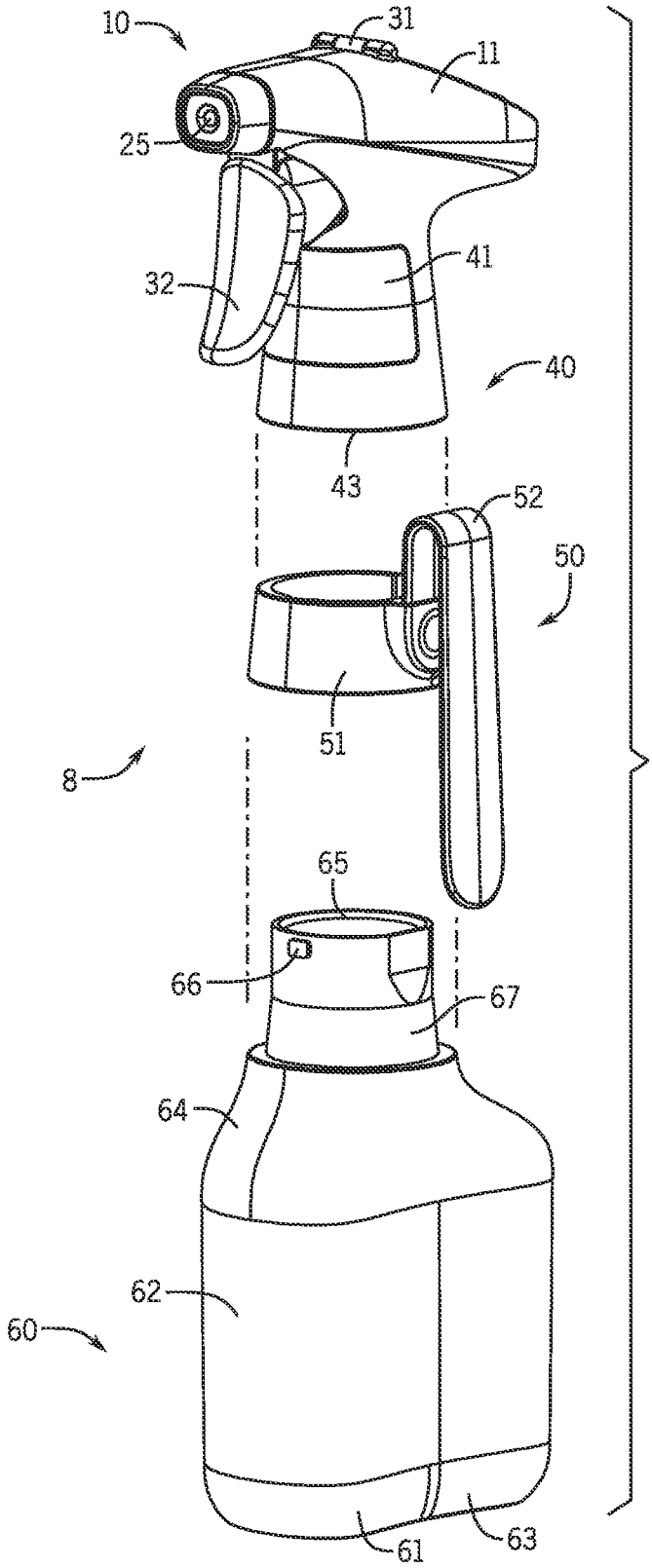
FIG. 2 is an exploded view of the trigger sprayer of FIG. 1.

Finally, the bottle 60 is defined by a bottom or end wall 61 and a side wall 62 which extends away from the end wall and tapers through a shoulder region 64 of the bottle 60 towards the bottle neck 67, wherein the neck 67 is seen in FIG. 2. FIG. 1 also shows the concavity 63 on one side of the bottle 60. The concavity 63 extends from the end wall 61 of the bottle 60 to a shoulder region 64 of the side wall 62 of the bottle 60.

Looking at FIG. 2, the components of the fluid delivery device 8 including the dispenser 10, the clip 50 and bottle 60 can be seen. FIG. 2 shows additional features of the device which are hidden in FIG. 1. First, the lower end 43 of the tubular part 40 is more clearly visible. Second, a number of features of the bottle 60 are shown including the bottle opening 65 and the quarter turn bayonet fitting 66 which is disposed on the bottle neck 67. FIG. 2 also shows that the collar 51 of the clip 50 is secured to the bottle 60, wherein the clip 50 is arranged in facing relationship with the concavity 63 in the side wall 62 of the bottle 60.

Figure 3:
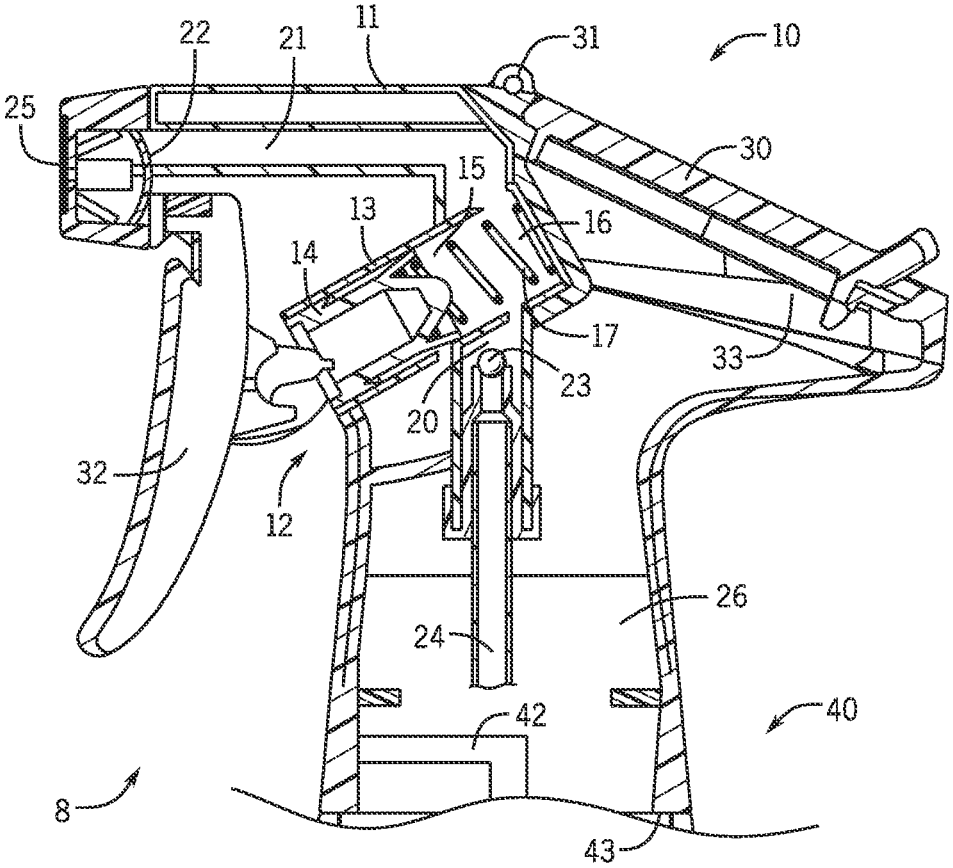
FIG. 3 is a detailed cross-sectional view of the trigger sprayer of FIG. 1 taken along the line 3-3 of FIG. 1.
Figure 8:
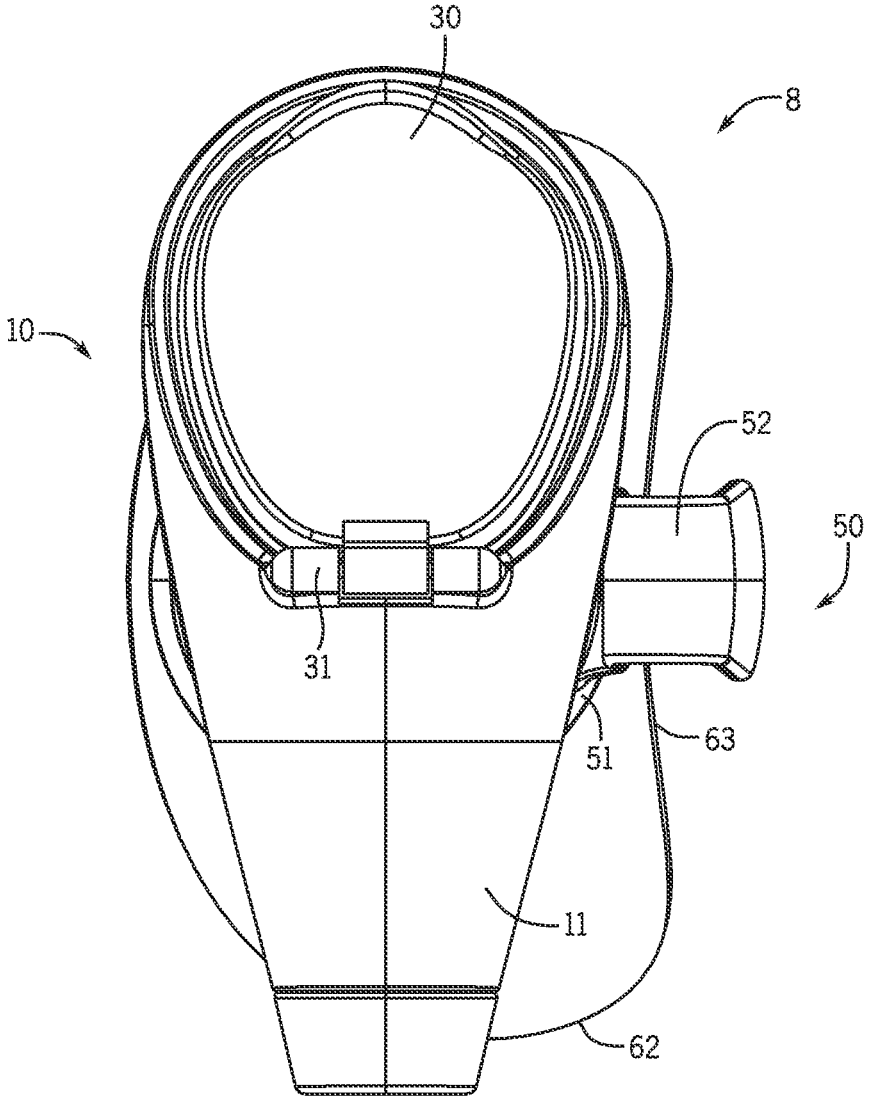
FIG. 8 is a top plan view of the trigger sprayer of FIG. 1.

FIG. 3 shows a cross-section of the sprayer assembly 10. The sprayer assembly 10 has a body 11 that has attachment means to attach the body 11 to the bottle 60 (not shown in FIG. 3) such as the bayonet channel 42. The bayonet fitting 66 (see FIG. 2) is moved up into the bayonet channel 42 and then the sprayer assembly 10 is rotated a quarter turn in the horizontal section of the bayonet channel 42 to secure the sprayer assembly 10 to the bottle neck 67. Looking at FIG. 8, the fluid delivery device 8 is in a right handed configuration in which the concavity 63 on the side of the bottle 60 faces to the right when the fluid delivery device 8 is viewed with the resealable lid 30 at the top as in FIG. 8. When the right handed configuration of the fluid delivery device 8 as shown in FIG. 8 is clipped on the right side of the belt of a user, the fluid discharge orifice 25 faces forward with respect to the user.

The body 11 can include another bayonet channel of the same configuration on the opposite inner surface of the body 11. The bayonet fitting 66 (see FIG. 2) can moved up into the opposite bayonet channel and then the sprayer assembly 10 can be rotated a quarter turn in the horizontal section of the opposite bayonet channel to secure the sprayer assembly 10 to the bottle neck 67. When using this connection method, a left handed configuration is formed which is a mirror image of FIG. 8. When the left handed configuration of the fluid delivery device is clipped on the left side of the belt of a user, the fluid discharge orifice 25 faces forward with respect to the user. The left handed configuration can also be achieved by way of another quarter turn bayonet fitting on the opposite side of the bottle neck 67 wherein the opposite side bayonet fitting is moved up into the bayonet channel 42 and then the sprayer assembly 10 is rotated a quarter turn in the horizontal section of the bayonet channel 42 to secure the sprayer assembly 10 to the bottle neck 67.

The sprayer assembly 10 includes an engine 12 held by or formed within the body 11. The engine 12 includes a piston 14 and cylinder 13 having cylinder head space 15 above the face of the piston 14. Furthermore, a biasing means such as a compression spring 17 is positioned in the cylinder 16 and in contact with the piston 14. A cylindrical chamber 16 is provided that is in fluid communication with the cylinder head space 15 and a fluid inlet conduit 20. The sprayer assembly 10 also includes a cylindrical dip tube 24 for transferring fluid to the chamber 16 from the bottle 60 via the fluid inlet conduit 20. The fluid transfer means includes a ball check valve 23 which allows fluid being transferred via the fluid transfer means to flow only toward and not away from the chamber 16 via the fluid inlet conduit 20.

The sprayer assembly 10 also includes a finger operated trigger 32 for reciprocatingly moving the piston 14 within the cylinder 16, alternatingly increasing and decreasing the cylinder head space 15 to draw liquid into the chamber 16 and then expel liquid from the chamber 16. The sprayer assembly 10 also includes a circular discharge orifice 25, together with a cylindrical discharge conduit 21 that provides fluid communication between the chamber 16 and the discharge orifice 25. The discharge conduit 21 has a discharge check valve 22 that permits fluid to move toward the discharge orifice 25 and not back toward the chamber 16.

It can be seen in FIG. 3 that the sprayer assembly 10 includes the resealable lid 30 operated on the hinge 31. The resealable lid 30 allows access to the fluid refill conduit 26. The fluid refill conduit 26 is in fluid communication with the interior space of the bottle 60, wherein the lower end 43 of the tubular neck region 40 contacts the collar 51 of the clip 50 when the fluid delivery device is assembled.

Figure 4:
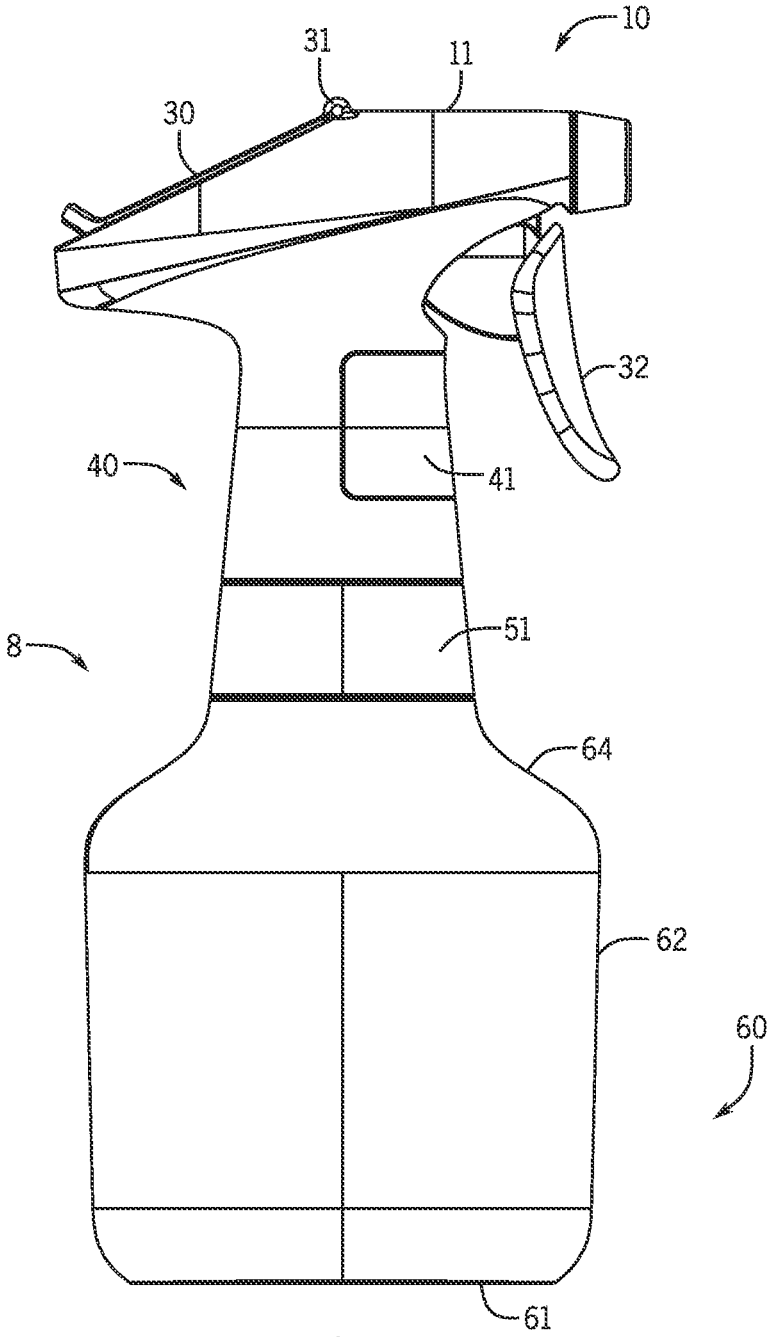
FIG. 4 is a left side elevational view of the trigger sprayer of FIG. 1.
Figure 5:
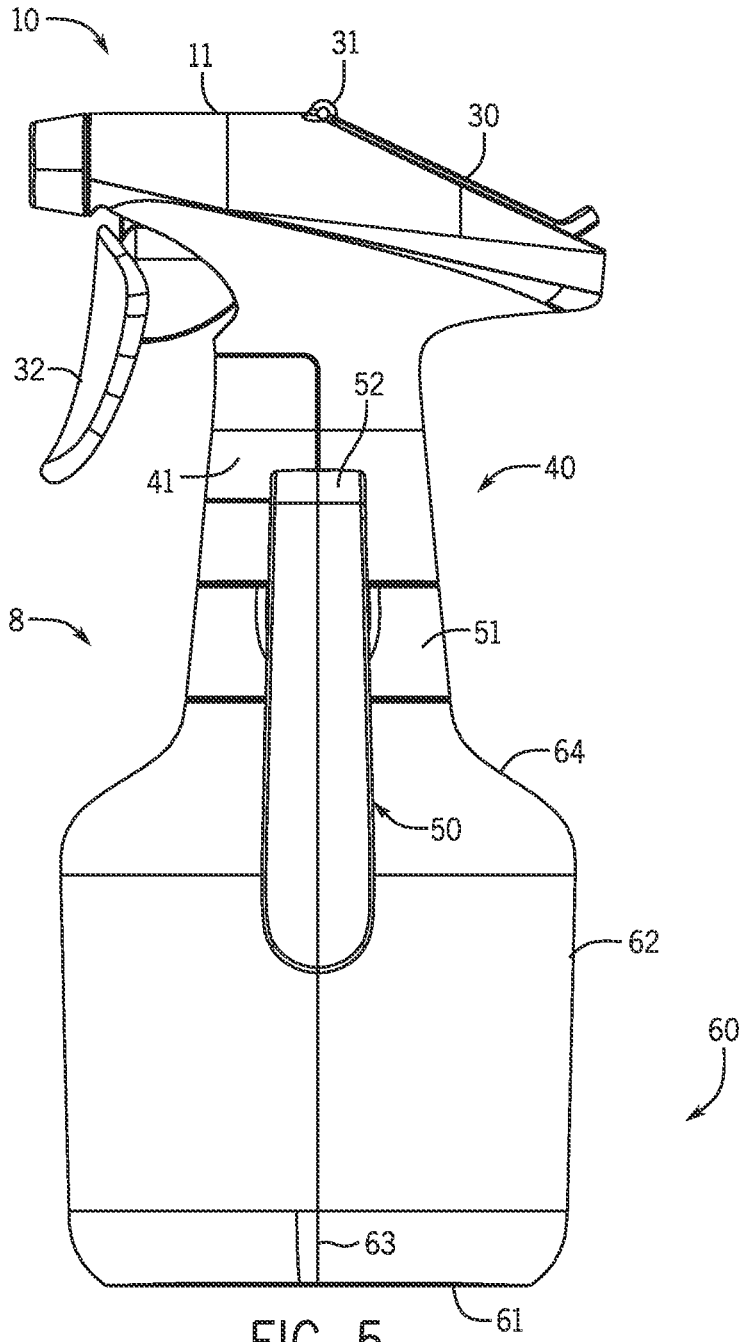
FIG. 5 is a right side elevational view of the trigger sprayer of FIG. 1.

It can be seen from FIGS. 4 and 5 that the translucent window 41 extends partway around the left and right side of the tubular part 40 of the sprayer assembly 10. The collar 51 of the clip 50 is also seen to extend around the circumference of the neck 67 of the bottle 60. In addition, FIG. 5 shows how the clip 50 is arranged in facing relationship with the concavity 63 in the side wall 62 of the bottle 60.

Figure 6:
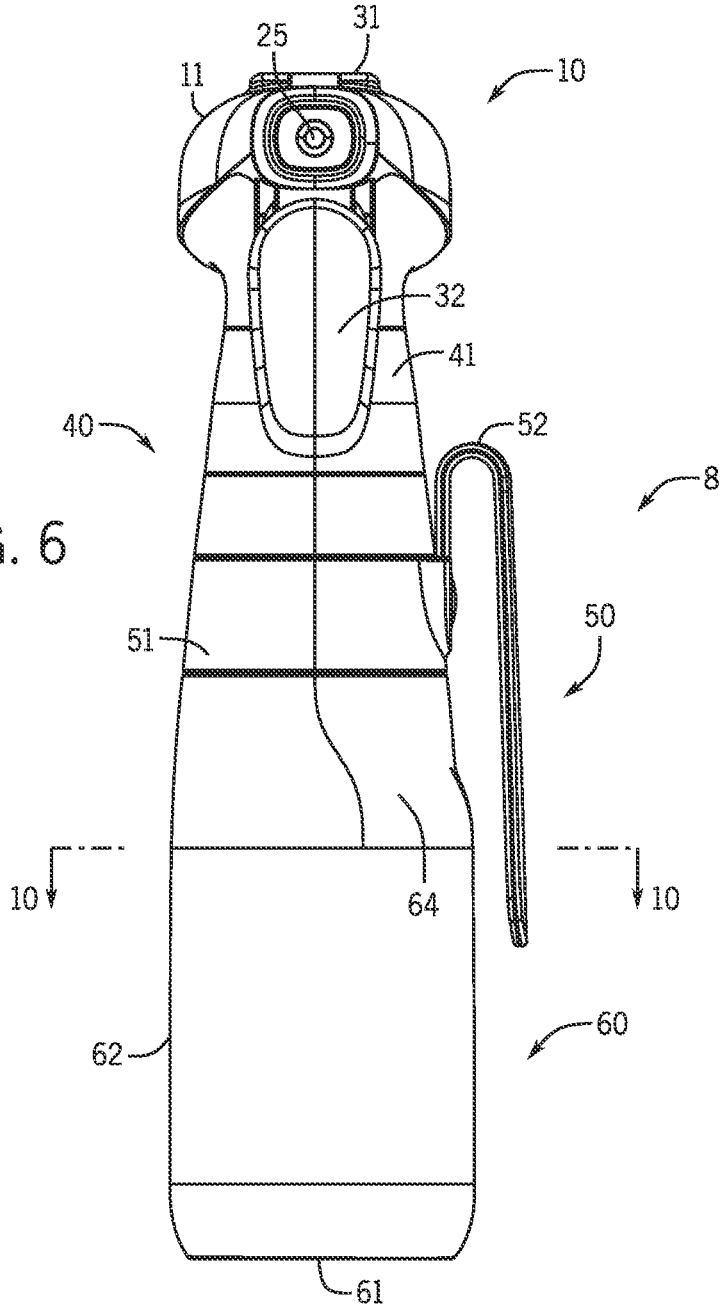
FIG. 6 is a front elevational view of the trigger sprayer of FIG. 1.
Figure 7:
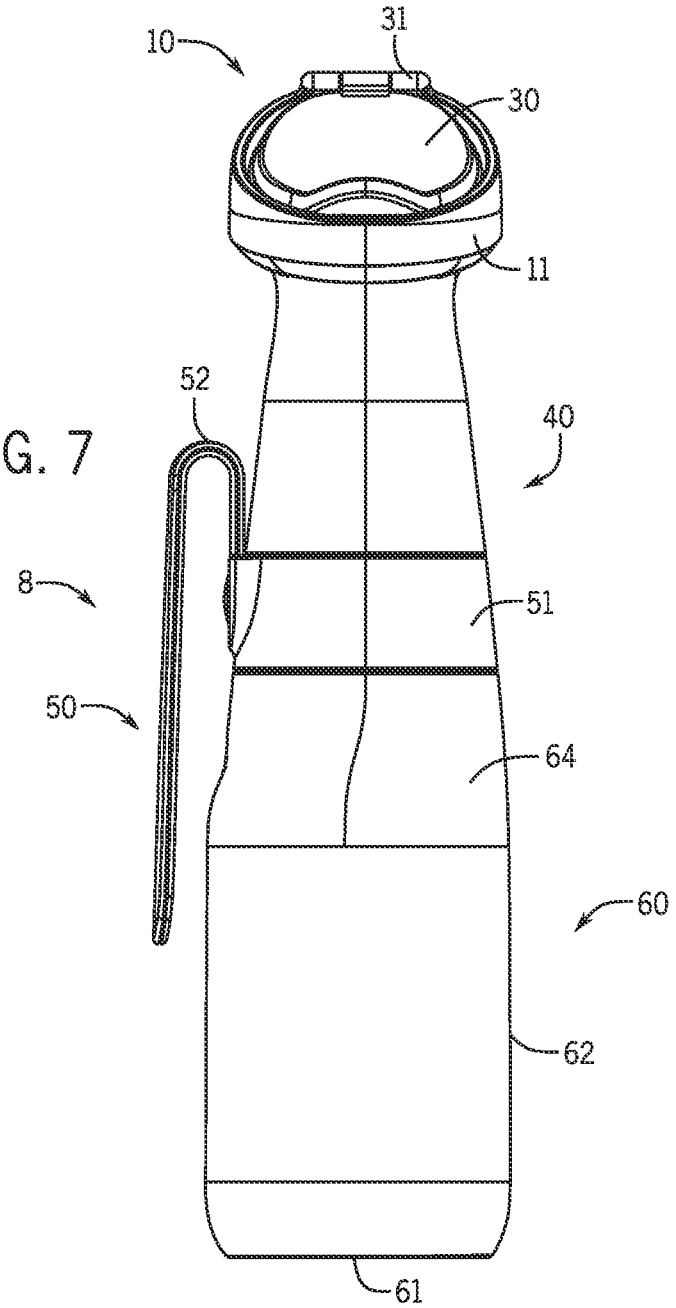
FIG. 7 is a rear elevational view of the trigger sprayer of FIG. 1.

It can be seen from FIG. 6 that the translucent window 41 extends around the front of the tubular part 40 of the sprayer assembly 10 is shown. By contrast, in FIG. 7, the translucent window 41 is shown to not extend around the back of the tubular part 40. FIGS. 6 and 7 show the collar 51 of the clip 50 as it extends around the circumference of the neck 67 of the bottle 60 and further, how the clip 50 is arranged in facing relationship with the concavity 63 in the right side wall 62 of the bottle 60. Finally, FIG. 7 shows the relative position of the resealable lid 30 and the lid hinge 31 with respect to the body 11 of the sprayer assembly 10.

Figure 9:
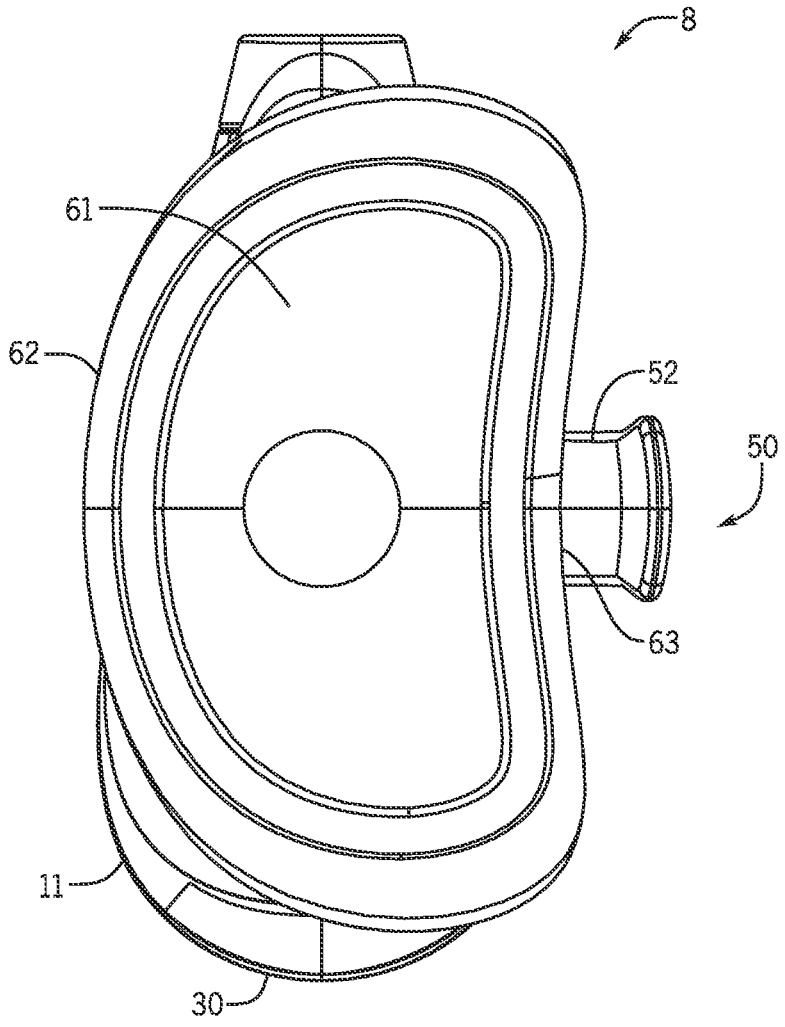
FIG. 9 is a bottom plan view of the trigger sprayer of FIG. 1.

FIG. 8 shows the relative position of the resealable lid 30 and the lid hinge 31 with respect to the body 11 of the sprayer assembly 10. FIGS. 8 and 9 also present views of the concavity 63 in the right side wall 62 of the bottle 60 as well as how the clip 50 is arranged in facing relationship with the concavity 63. The bottom wall 61 of the bottle 60 is also viewed in FIG. 9.

Figure 10:
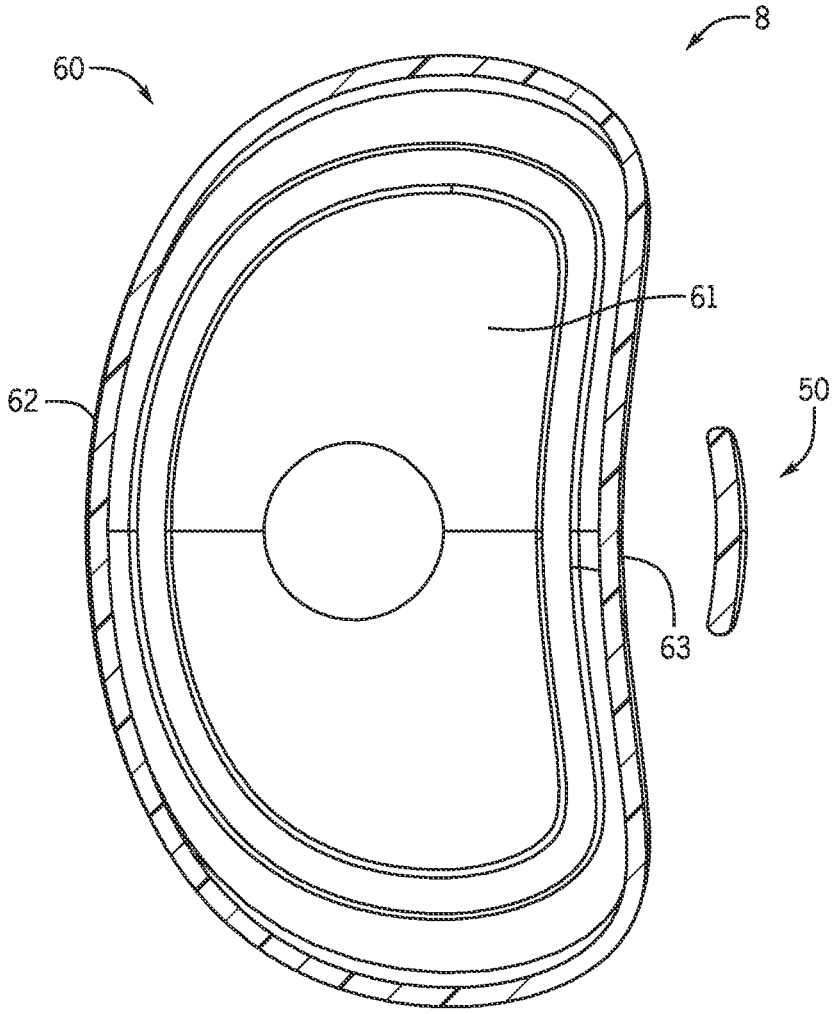
FIG. 10 is a cross-sectional view of the trigger sprayer of FIG. 1 taken along line 10-10 of FIG. 6.

The cross-sectional view of FIG. 10 shows positioning of the concavity 63 in the right side wall 62 of the bottle 60 and furthermore, the position of the clip 50 in a facing relationship to the concavity 63.

In operation of the fluid delivery device 8, the finger operated trigger 25 reciprocatingly moves the piston 14 within the cylinder 13, alternatingly increasing and decreasing the cylinder head space 15 to draw a fluid into the chamber 16 and then expel the fluid from the chamber 16. The fluid flows from the interior space of the bottle 60 through the cylindrical dip tube 24 and past the ball check valve 23 into the fluid inlet conduit 20. From the fluid inlet conduit 20, the fluid flows into the chamber 16 and then to the discharge conduit 21 toward the discharge orifice 25. The fluid then flows past the check valve 22 and out of the discharge orifice 25.

In further operation of the fluid delivery device 8, the resealable lid 30 can be opened by way of the lid hinge 31 to allow access to the fluid refill conduit. Fluid added to the device passes through the portal 33 created by opening the resealable lid 30. The fluid then moves through the fluid refill conduit 26 and into the interior space of the bottle. The amount of fluid in the device can be monitored through the translucent window 41. For example, overfilling the device with fluid can be avoided by observing the fluid level within the device through the translucent window 41.

In addition to filling the device 8 with fluid and operating the device as a trigger sprayer, a further means of using the device 8 involves the clip 50 and concavity 63. In operation of the device 8, the clip 50 may be used to affix the device 8 to one's person. For example the clip 50 permits the device 8 to be affixed to an article of clothing such as a pocket or belt. The concavity 63 of the bottle 60 is designed to allow the device 8 to be worn comfortably. For instance, if the device 8 is affixed to a person's belt by way of the clip 50, the concavity 63 will accommodate the person's body shape.

Turning now to FIGS. 11-22, there is shown a second example embodiment of a fluid delivery device 108. The device 108 includes a trigger actuated sprayer assembly 110 above a bottle 160, and a clip 150 around the neck 167 of the bottle 160, wherein the neck 167 of the bottle 160 can be seen in FIG. 14. Upon further inspection of FIG. 11, it can be seen that the sprayer assembly includes a body 111 with a nozzle 125 having a fluid discharge orifice and a resealable closure 130 that operates on a lid hinge 131. The sprayer assembly 110 also has a finger trigger 132 to control dispensing of the liquid. The clip 150 includes a collar 151 and an inverted J-shaped section 152 of the clip 150 which is integral with the collar 151. The collar 151 is disposed between the tubular part 146 of the sprayer assembly 110 and the bottle 160. The tubular part 146 of the sprayer assembly 110 can be transparent or translucent thereby creating a viewing area on the sprayer assembly 110 for viewing the fluid refill conduit 126.

Figure 11:
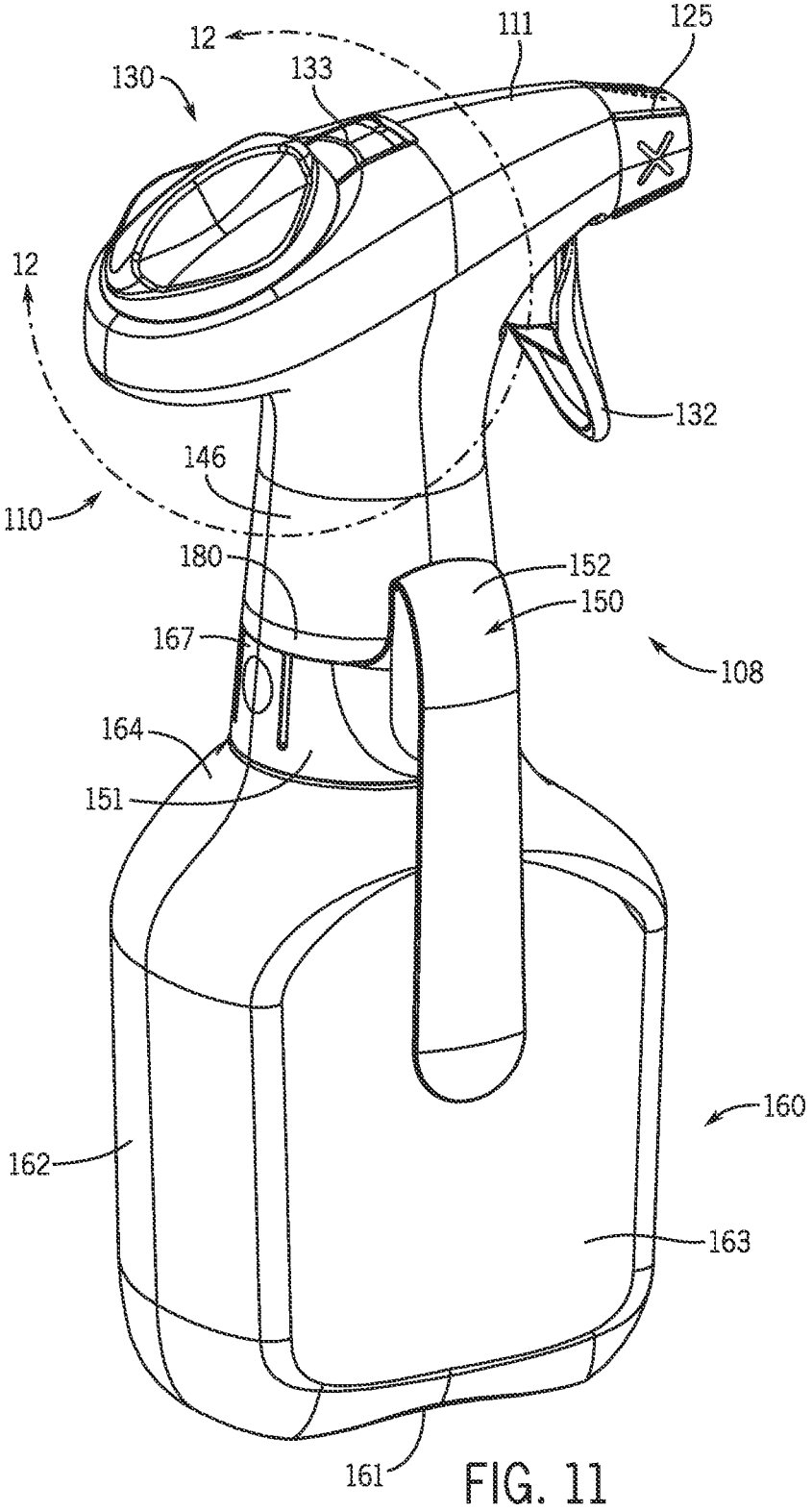
FIG. 11 is a top right rear perspective view of a second embodiment of a trigger sprayer with a bottle filling conduit.
Figure 14:
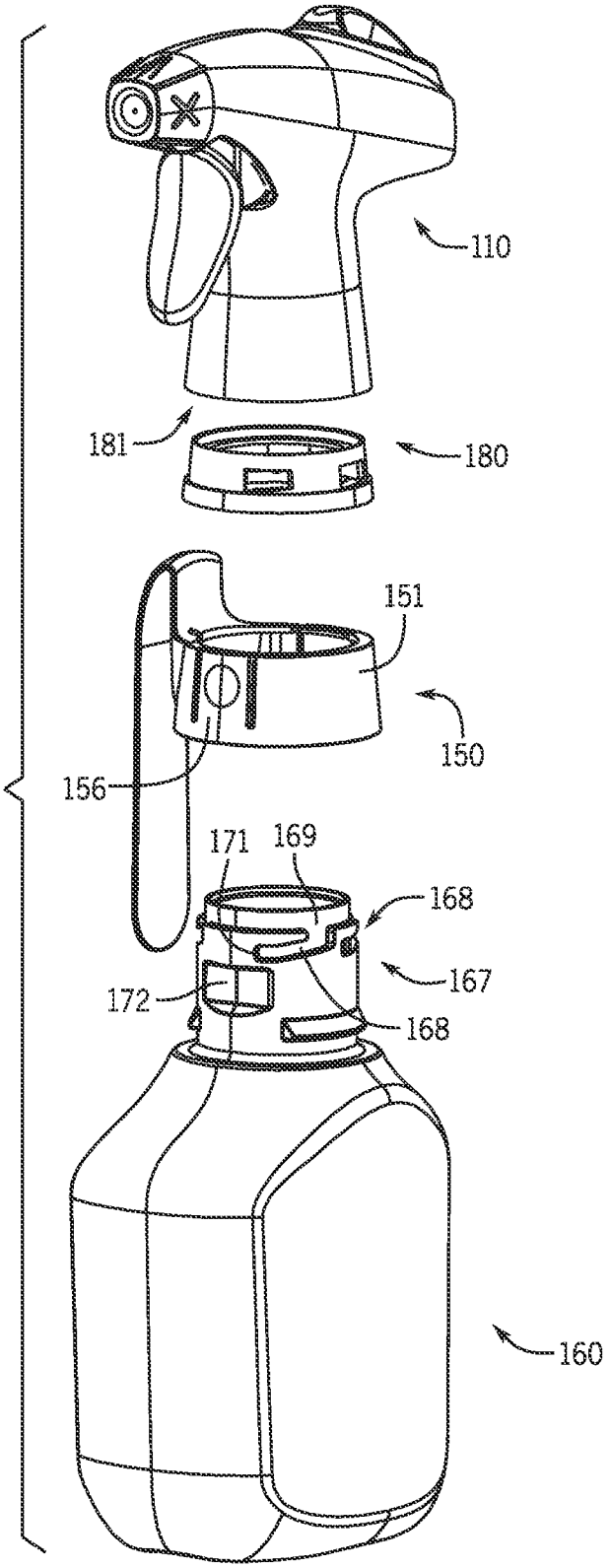
FIG. 14 is a top left front exploded perspective view of the trigger sprayer of FIG. 11.

The bottle 160 is defined by a bottom or end wall 161 and a side wall 162 which extends away from the end wall and tapers through a shoulder region 164 of the bottle 160 towards the bottle neck 167, wherein the neck 167 is seen in FIG. 14. FIG. 11 also shows the concavity 163 on one side of the bottle 160. The concavity 163 extends from the end wall 161 of the bottle 160 to a shoulder region 164 of the side wall 162 of the bottle 160. Non-limiting example volumes for the bottle 160 are 0.47 liters (16 ounces) and 0.94 liters (32 ounces).

The sprayer assembly 110 includes an engine 112 (similar to engine 12 of FIG. 3) held by or formed within the body 111. The engine of the sprayer assembly 110 includes a piston, a cylinder, a cylinder head space, a compression spring, a fluid inlet conduit, a cylindrical dip tube, and a ball check valve arranged as in the engine 12 of FIG. 3. Operation of the engine of the sprayer assembly 110 is similar to the engine 12 of FIG. 3. Specifically, in fluid delivery device 108, the finger operated trigger 132 reciprocatingly moves the piston within the cylinder, alternatingly increasing and decreasing the cylinder head space to draw a fluid into the chamber and then expel the fluid from the chamber. The fluid flows from the interior space of the bottle 160 through a cylindrical dip tube and past the ball check valve into the fluid inlet conduit. From the fluid inlet conduit, the fluid flows into the chamber and then to a discharge conduit toward the nozzle 125. The fluid then flows past a check valve and out of a discharge orifice of the nozzle 125.

Figure 12:
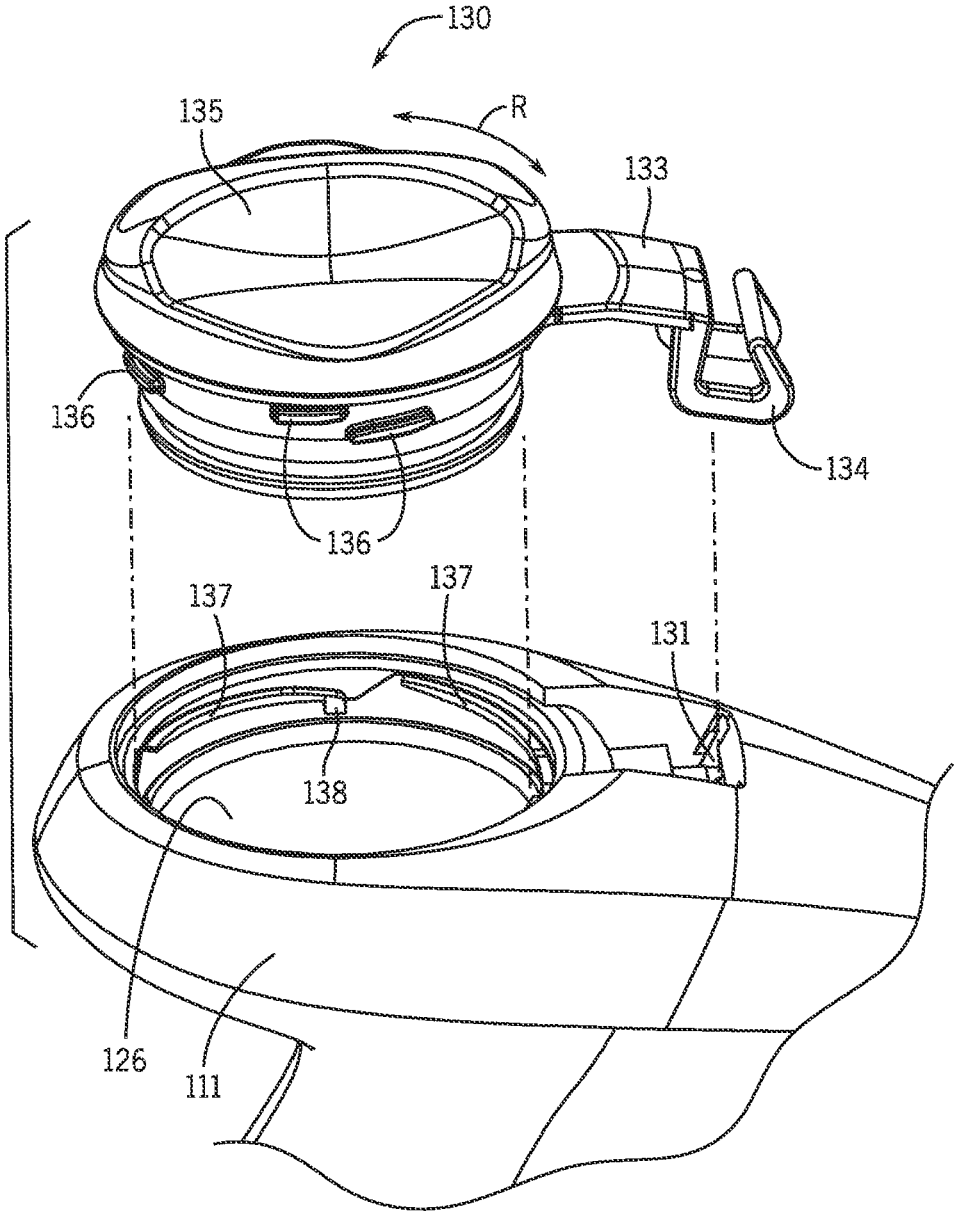
FIG. 12 is a detailed exploded perspective view taken along line 12-12 of FIG. 11 of the trigger sprayer of FIG. 11.

It can be seen in FIG. 12 that the sprayer assembly 110 includes the resealable closure 130 operated on a hinge 131. The resealable closure 130 allows access to a fluid refill conduit 126. The fluid refill conduit 126 is in fluid communication with the interior space of the bottle 160 when the fluid delivery device 108 is assembled as described below. The resealable closure 130 includes a connector strap 133 having an end 134 that engages the hinge 131. A cap 135 of the resealable closure 130 can rotate in directions R in FIG. 12 in a retainer opening of the connector strap 133. Spaced projections 136 on a side wall of the cap 135 engage protrusions 137 on an end of the fluid refill conduit 126 in a rotating sealing motion in direction R until being stopped at a stop 138 on the protrusions 137. In this manner, the resealable closure 130 can be flipped up to open and then resealed to close off the end of the fluid refill conduit 126. The connector strap 133 and cooperating hinge 131 allow the cap 135 to be moved away from the fluid refill conduit 126 for filling, but at the same time retain the cap 135 on the body 111 of the sprayer assembly 110.

Figure 13:
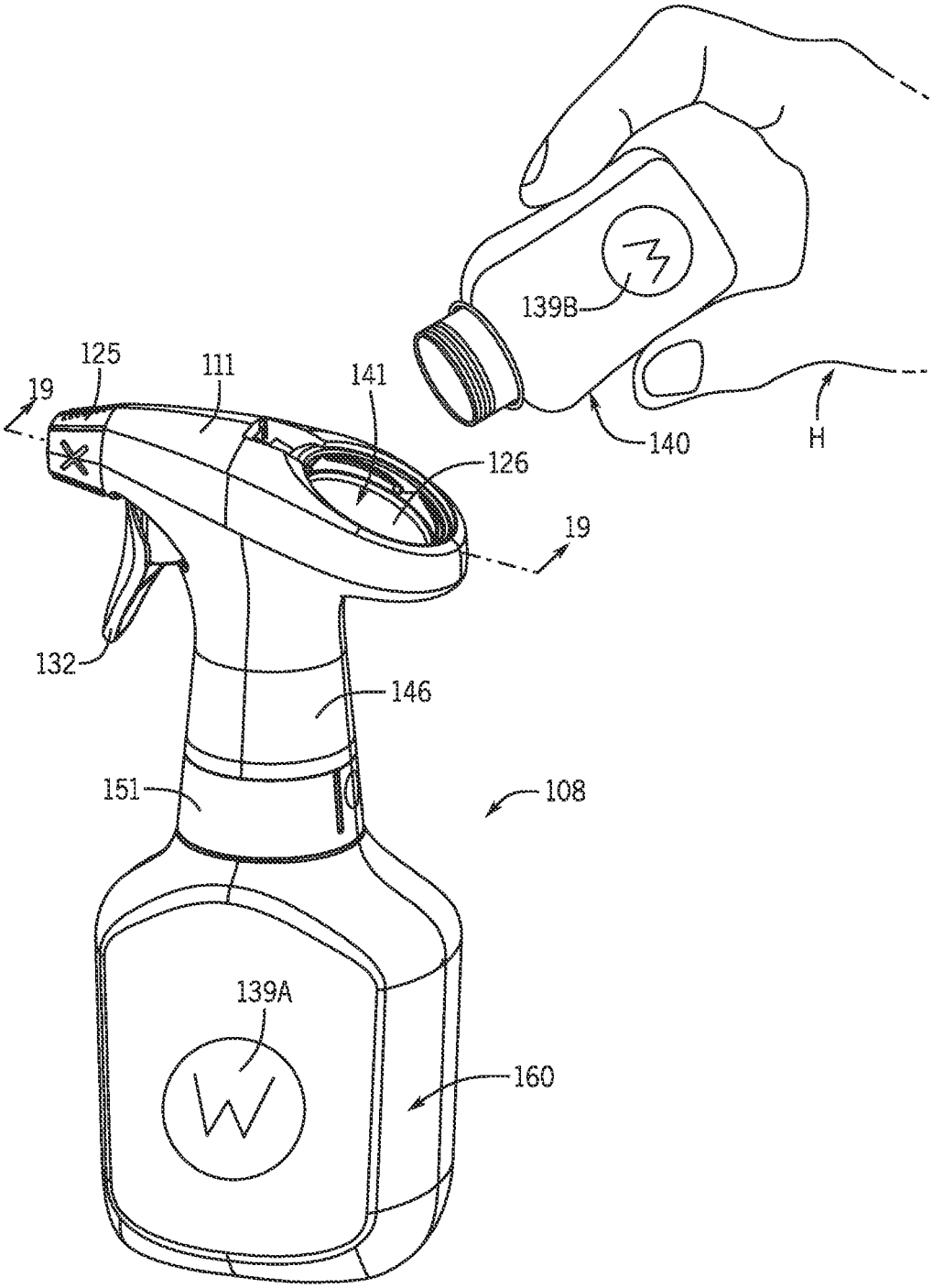
FIG. 13 is a top left rear perspective view of the trigger sprayer of FIG. 11 with the attached resealable closure removed for clarity and with a user shown refilling the bottle.

Looking now at FIG. 13, a user's hand is shown holding a chemical concentrate container 140. The concentrate in the container 140 can be selected such that when the concentrate is diluted with a diluent (typically water), any number of different fluid products is formed. Non-limiting example products include general purpose cleaners, kitchen cleaners, bathroom cleaners, window cleaners, degreasers, dust inhibitors, dust removal aids, floor and furniture cleaners and polishes, multi-surface cleaners, glass cleaners, anti-bacterial cleaners, fragrances, deodorizers, soft surface treatments, fabric protectors, laundry products, fabric cleaners, fabric stain removers, tire cleaners, dashboard cleaners, automotive interior cleaners, and/or other automotive industry cleaners or polishes, or even insecticides. The chemical concentrate container 140 can be formed from a suitable material such as polymeric material (e.g., polyethylene or polypropylene), and in certain embodiments, the chemical concentrate container 140 comprises a transparent material that allows the user to check the level of chemical concentrate in the chemical concentrate container 140. It should be appreciated that the term "chemical" when used to describe the concentrate in the chemical concentrate container 140 can refer to one compound or a mixture of two or more compounds. The chemical concentrate container 140 has an externally threaded outlet neck. A closure cap 144 (see FIG. 22) is threaded onto the neck of the chemical concentrate container 140.

Still looking at FIG. 13, in operation of the fluid delivery device 108, chemical concentrate can added to the bottle 160 through the opening 141 created by opening the resealable closure 130. The chemical concentrate moves through the fluid refill conduit 126 and into the interior space of the bottle 160. A diluent (typically water) can then be added in the same manner. A fill line on the bottle 160 can provide an indication of the proper amount of diluent to achieve a predetermined dilution ratio of the diluent to concentrate. Of course, the diluent can be added first and then the chemical concentrate.

In certain cleaning occasions, a user may wish to have two or more separate devices 108 for different cleaning tasks. For example, a bathroom cleaning occasion may require the use of a bathroom cleaner, a window cleaner, and a deodorizer. It may be beneficial to keep these three chemicals in separate devices 108 to avoid mixing of incompatible compounds. For instance, certain delicate fragrances in the deodorizer may be affected by cleaning compounds in the window or bathroom cleaner.

FIG. 13 depicts an advantageous option in this circumstance. The bottle 160 of the fluid delivery device 108 includes indicia 139A, which in this non-limiting example is a label with the letter W indicating a window cleaner. Likewise, the chemical concentrate container 140 includes indicia 139B, which in this non-limiting example is a matching label with the letter W indicating a window cleaner. When the bottle 160 is running low or depleted of window cleaner, a user can choose a refill chemical concentrate container 140 that includes indicia 139B with the letter W indicating a window cleaner. The bottle 160 can be refilled with the window cleaner and diluent water as described above. Alternatively, container 140 may be a larger container (e.g., one gallon) including indicia 139B wherein the container 140 holds a ready to use product that does not require dilution.

In the example bathroom cleaning occasion noted above, a user could have: (i) a bathroom cleaner fluid delivery device 108 with a bottle 160 labeled "B" and a plurality of chemical concentrate containers 140 labeled "B"; (ii) a deodorizer fluid delivery device 108 with a bottle 160 labeled "D" and a plurality of chemical concentrate containers 140 labeled "D"; and (iii) a window cleaner fluid delivery device 108 with a bottle 160 labeled "W" and a plurality of chemical concentrate containers 140 labeled "W. Other indicia can be used. In one example embodiment, a certain color can be used for the indicia 139A, 139B, e.g., the bathroom cleaner, the deodorizer and the window cleaner bottles 160 and chemical concentrate containers 140 can include respectively, green labels, yellow labels, and blue labels. In another example embodiment, a certain number can be used for the indicia 139A, 139B, e.g., the bathroom cleaner, the deodorizer and the window cleaner may be indicated by a "1", "2", and "3" respectively. The indicia system is also suitable for a container 140 holding a ready to use product that does not require dilution. For example, a window cleaner device 108 with a bottle 160 labeled "W" could be refilled from a container 140 labeled "W" holding a ready to use window cleaner. In another example embodiment, the cap 135 and the cap 144 may have the same color as the indicia 139A, 139B.

Figure 18:
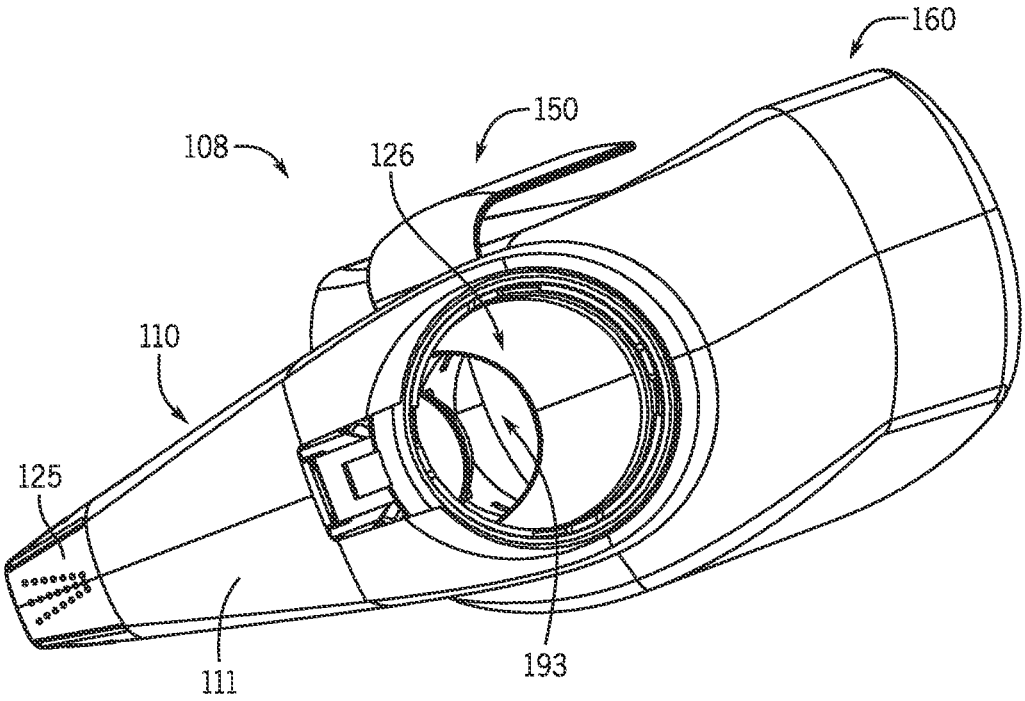
FIG. 18 is a top left rear perspective view of the trigger sprayer of FIG. 11 with the attached resealable closure removed for clarity.
Figure 19:
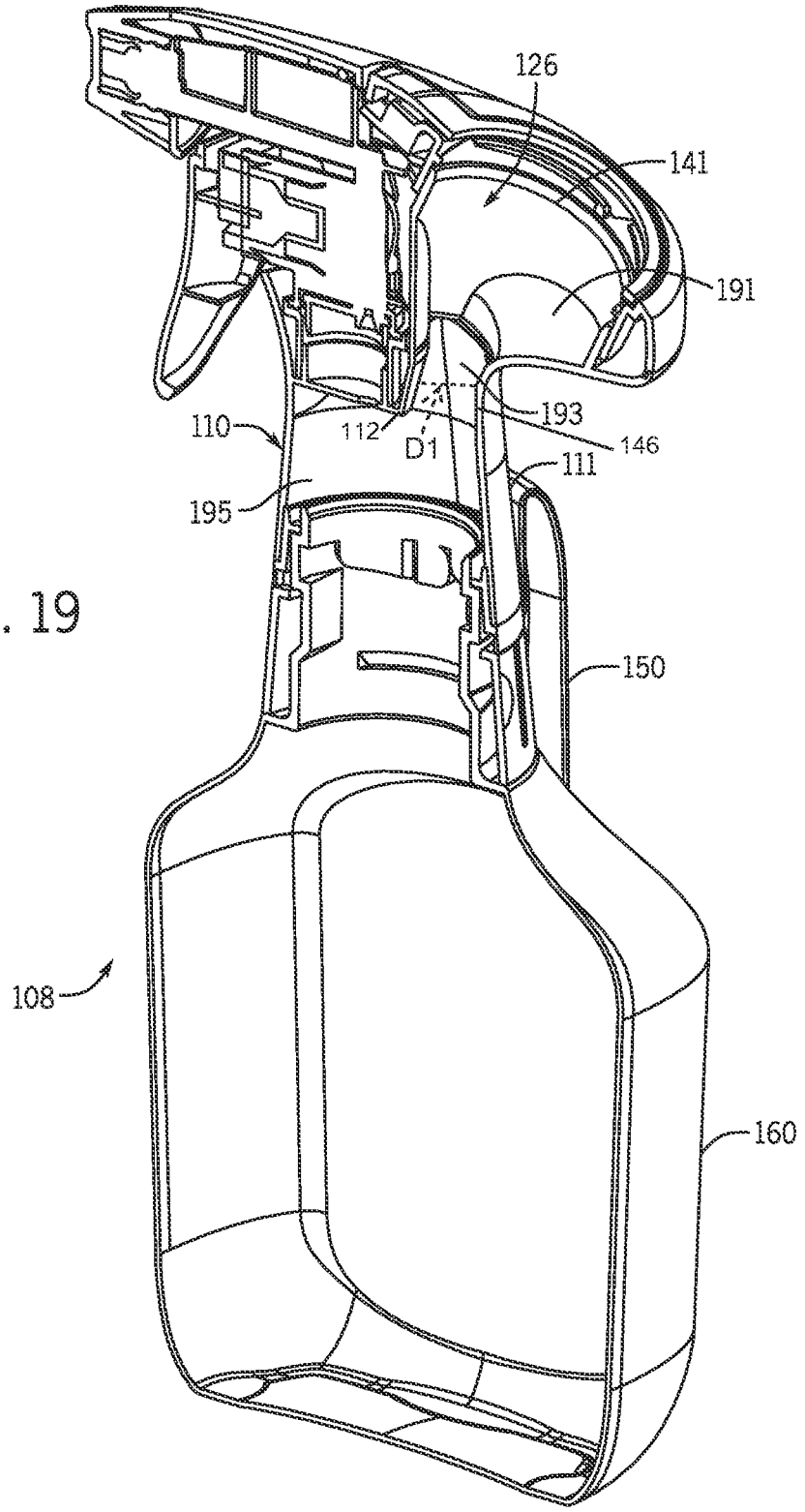
FIG. 19 is a cross-sectional view taken along line 19-19 of FIG. 13 with the attached resealable closure removed for clarity.

FIGS. 18 and 19 show features of the fluid refill conduit 126 of the fluid delivery device 108. The fluid refill conduit 126 is housed within the body 111 of the sprayer assembly 110. As the fluid refill conduit 126 extends from the opening 141 toward the bottle 160, the fluid refill conduit 126 includes a first generally cylindrical upper section 191, a second generally arcuate middle section 193, and a third generally cylindrical lower section 195. The first section 191 has a first transverse area with a first diameter, and the third section 195 has a second transverse area with a second diameter. The intermediate section 193 has a third transverse area with a third diameter smaller than the first diameter and the second diameter. When measuring diameter of the arcuate middle section 193, one uses line D1 of FIG. 19 between the engine 112 and the tubular part 146 of the sprayer assembly 110.

Figure 20:
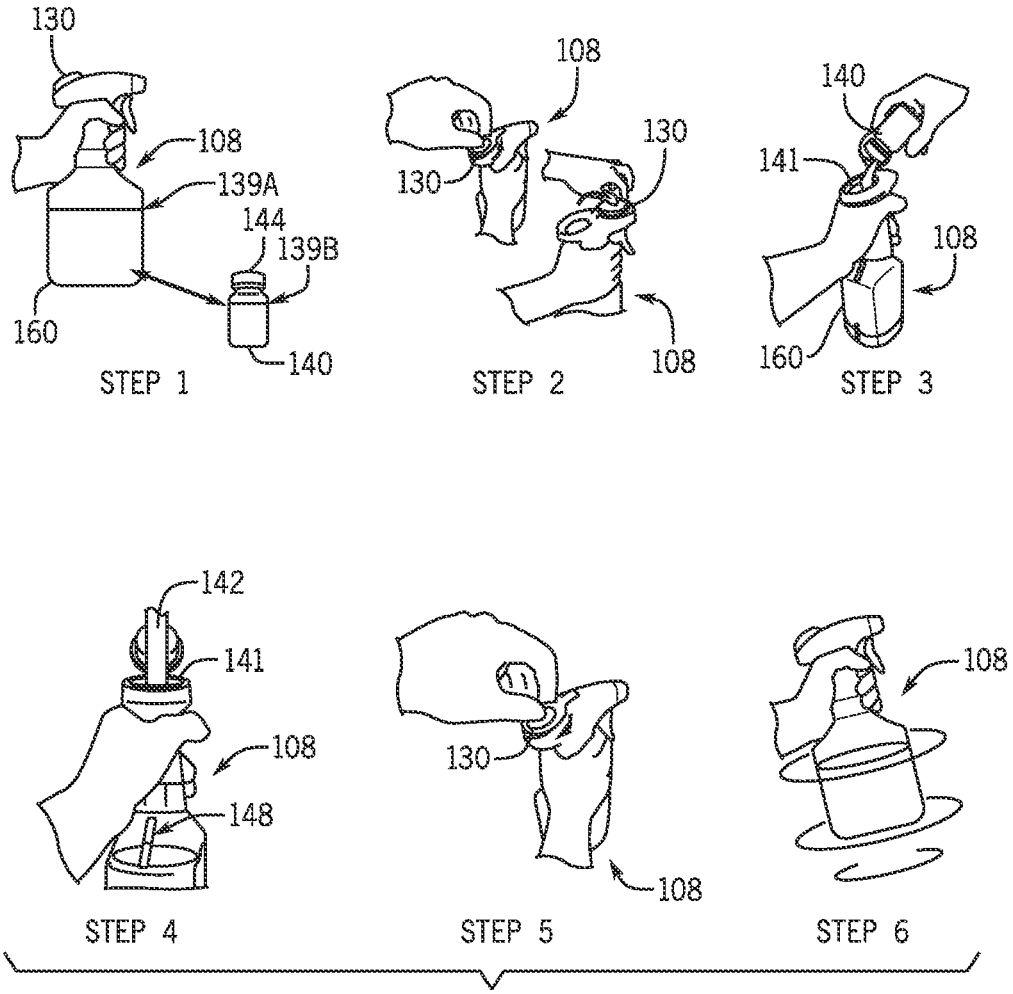
FIG. 20 is a step by step depiction of filling an empty bottle of the trigger sprayer of FIG. 11.

FIG. 20 shows a step by step depiction of filling an empty bottle 160 of the fluid delivery device 108. In Step 1, the user makes sure that the colors of the indicia 139A, 139B match. In Step 2, the user removes the closure 130 by twisting and flipping open. In Step 3, the user pours all of the contents of container 140 into the empty bottle 160 via opening 141. In Step 4, water 142 is added to the A fill line 148A of an upper fill indicator 148 (see FIG. 21) in the side of the bottle 160. In Step 5, the closure 130 is resealed by flipping closed and locking with a one-quarter turn. In Step 6, the fluid delivery device 108 is swirled to mix the contents of container 140 and the water 142 that have been added to the bottle 160.

Figure 21:
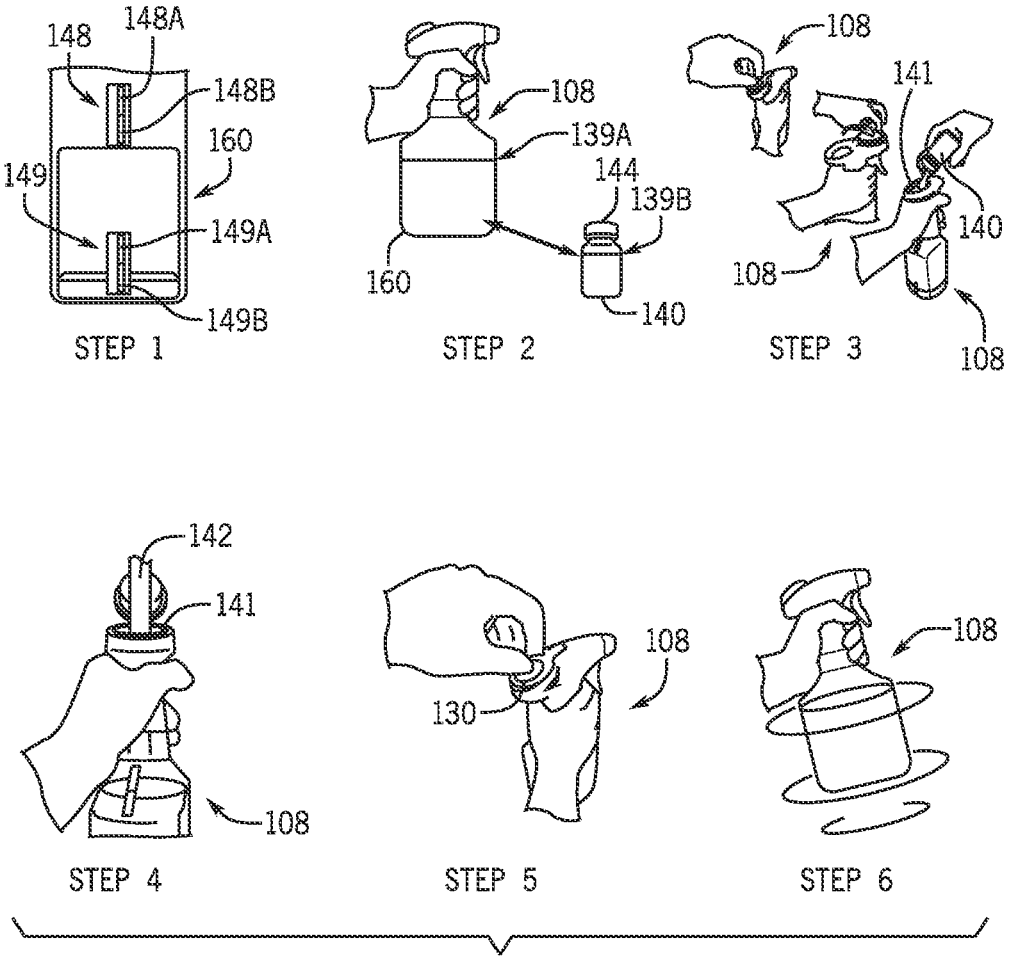
FIG. 21 is a step by step depiction of filling an almost empty bottle of the trigger sprayer of FIG. 11.

FIG. 21 is a step by step depiction of filling an almost empty bottle 160 of the fluid delivery device 108. A user may wait until solution reaches the A fill line zone 149A or the B fill line zone 149B of a lower fill indicator 149 before refilling. In Step 1 of FIG. 21, the user notes which lower fill line zone (149A or 149B) the liquid level is at before preparing more solution. In Step 2, the user makes sure that the colors of the indicia 139A, 139B match. In Step 3, the user removes the closure 130 by twisting and flipping open, and the user pours all of the contents of container 140 into the empty bottle 160 via opening 141. In Step 4, water 142 is added via opening 141. If the user started at the A fill line zone 149A of the lower fill indicator 149, the user adds water to the A fill line zone 148A of the upper fill indicator 148. If the user started at the B fill line zone 149B of the lower fill indicator 149, the user adds water to the B fill line zone 148B of the upper fill indicator 148. When using a larger container (e.g., 3.8 liters—one gallon) including indicia 139B wherein the container 140 holds a ready to use product that does not require dilution, the user makes sure that the colors of the indicia 139A, 139B match, and pours the contents of container 140 into the empty bottle 160 up to the upper fill indicator 148. In Step 5, the closure 130 is resealed by flipping closed and locking with a one-quarter turn. In Step 6, the fluid delivery device 108 is swirled to mix the contents of container 140 and the water 142 that have been added to the bottle 160.

In the fluid delivery device 108, the clip 150 and the concavity 163 in the bottle 160 may be used to comfortably carry the fluid delivery device 108 next to the user's hip. The clip 150 permits the device 108 to be affixed to a pocket or belt, and the concavity 163 of the bottle 160 is designed to allow the device 108 to accommodate the user's hip or other body part. In addition, the sprayer assembly 110 of the fluid delivery device 108 is quickly adjustable from a first orientation in which the nozzle 125 faces forward when carried next to a user's right hip to a second orientation in which the nozzle 125 faces rearward when carried next to the user's right hip. The second orientation also allows the nozzle 125 to face forward when carried next to the user's left hip.

FIGS. 14 to 17 show how the sprayer assembly 110 can be installed on the neck 167 of the bottle 160 and how the orientation in which the nozzle 125 faces can be adjusted as mentioned above.

Figure 15:
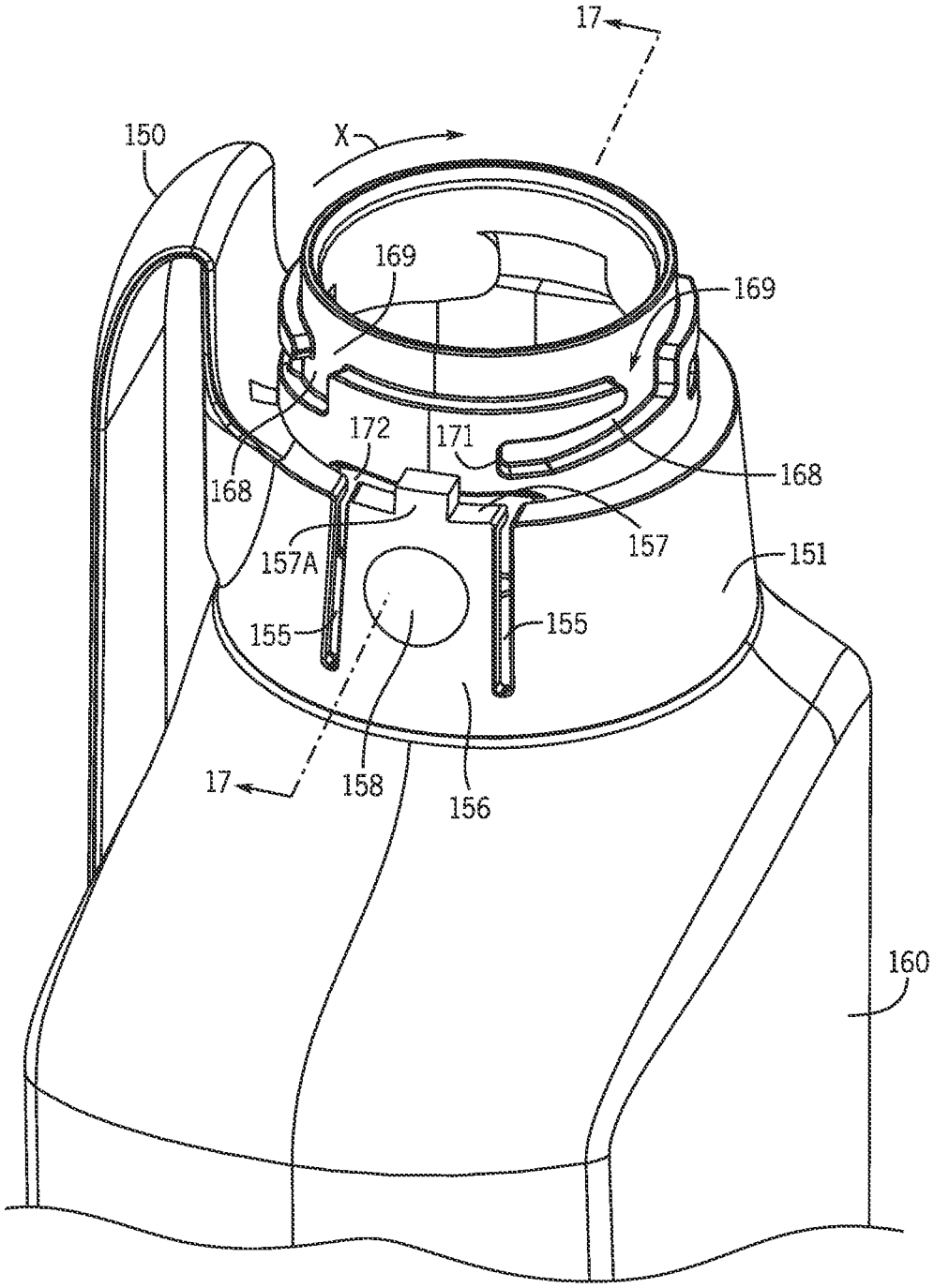
FIG. 15 is a top left front perspective view of the bottle and the clip of trigger sprayer of FIG. 11.
Figure 17:
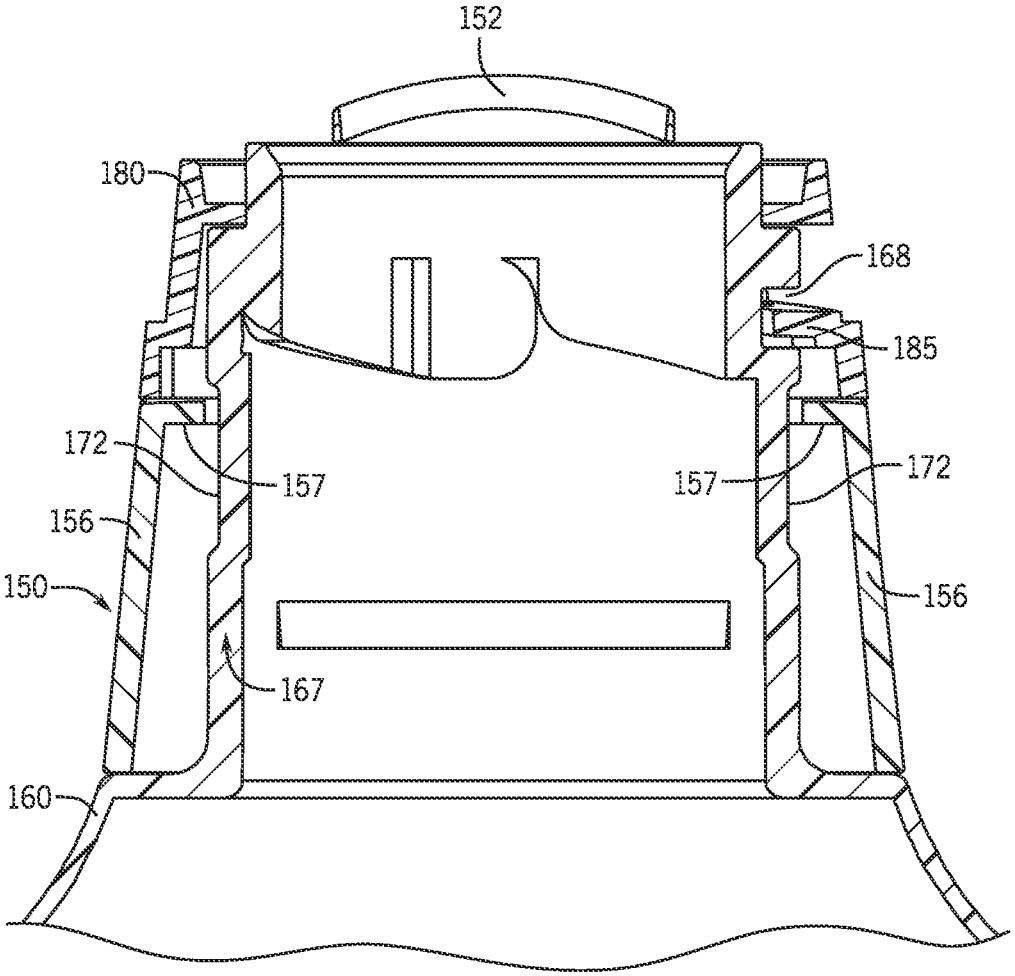
FIG. 17 is a cross-sectional view taken along line 17-17 of FIG. 15 of the bottle, the clip and the bottle attachment ring of the trigger sprayer of FIG. 11.

Looking at FIGS. 14 and 15 and 17, the collar 151 of the clip 150 includes a pair of slots 155 that define a pair of movable sections 156 of the collar 151. A top end of the movable section 156 has an inwardly directed flange 157 with an upwardly extending tab 157A. A dimple 158 in the movable section 156 provides a location where a user's thumb can press the movable section 156 inward toward the neck 167 of the bottle 160.

Still looking at FIGS. 14 and 15 and 17, the neck 167 of the bottle 160 includes four channels 168 equally spaced around the neck 167. An opening 169 is at one end of each channel 168 and the opposite end of each channel 168 ends in a stop wall 171. The neck 167 of the bottle 160 also includes a pair of opposed recesses 172.

Figure 16:
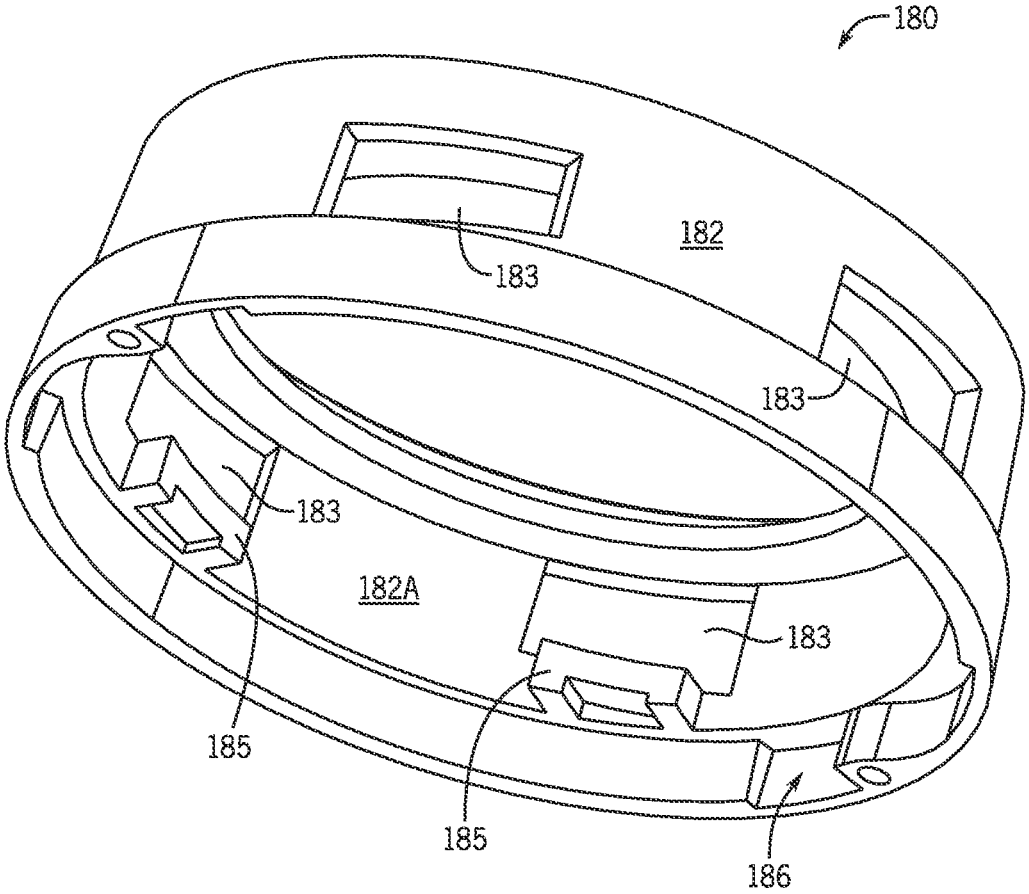
FIG. 16 is a perspective view of the bottle attachment ring of the trigger sprayer of FIG. 11.

Looking now at FIGS. 11 and 14 and 16, a bottle attachment ring 180 is secured in the bottom opening 181 of the sprayer assembly 110. The bottle attachment ring 180 has a side wall 182 with openings 183 that may assist in securing the bottle attachment ring 180 in the bottom opening 181 of the sprayer assembly 110 such that the bottle attachment ring 180 does not rotate from a predetermined location with respect to the sprayer assembly 110. Extending inward from the inner surface 182A of the side wall 182 are mounting tabs 185.

The sprayer assembly 110 can be installed on the bottle as follows. The sprayer assembly 110 with attached bottle attachment ring 180 is lowered over the neck 167 of the bottle 160 such that each of the mounting tabs 185 enters one of the openings 169 of one of the channels 168 of the neck 167 of the bottle 160. The sprayer assembly 110 is twisted in an installation direction X (see FIG. 15) such that each of the mounting tabs 185 moves in one of the channels 168 until the mounting tabs 185 each contact the stop wall 171 of the channel 168 in which the mounting tab 185 has moved. The tabs 157A of the movable sections 156 also engage notches 186 (see FIG. 16) in the bottle attachment ring 180 in a locking engagement. The sprayer assembly 110 is therefore attached to the bottle 160.

To change the orientation in which the nozzle 125 faces, the user presses on the movable sections 156 of the collar 151 of the clip 150 such that the flanges 157 move toward the recesses 172 in the neck 167 of the bottle 160. This is best shown in FIG. 17. The tabs 157A of the movable sections 156 disengage from the notches 186 of the bottle attachment ring 180 so that the sprayer assembly 110 can be twisted in a direction opposite installation direction X (see FIG. 15) until each of the mounting tabs 185 exits its associated opening 169 of one of the channels 168 of the neck 167 of the bottle 160. The sprayer assembly 110 is then rotated 180 degrees and reinstalled on the bottle 160 as described above.

Figure 22:
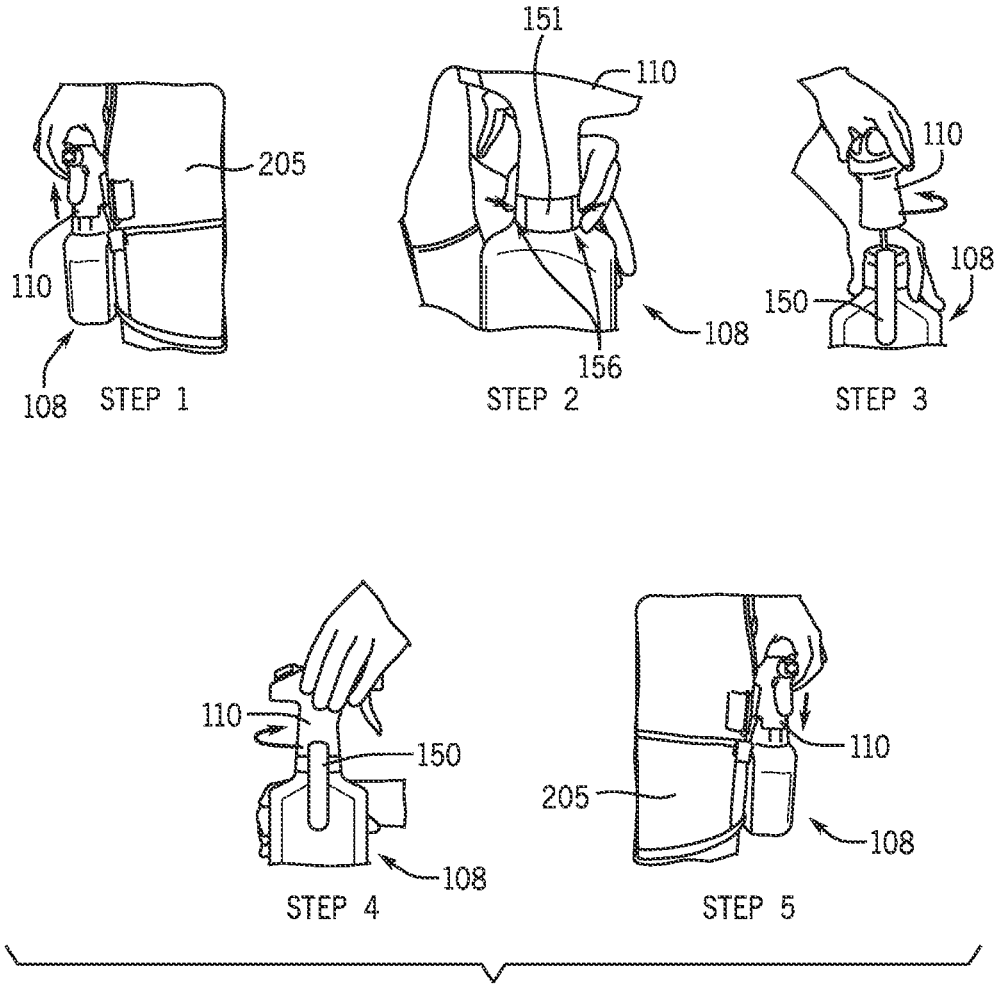
FIG. 22 is a step by step depiction of adjusting the trigger sprayer of FIG. 11 for left or right handed use.

FIG. 22 also shows a step by step depiction of adjusting the sprayer assembly 110 for left or right handed use. In Step 1, the fluid delivery device 108 in the right handed orientation is unclipped from a user's vest 205. In Step 2, the movable sections 156 of the collar 151 are pinched inward such that the movable sections 156 disengage from the notches 186 of the bottle attachment ring 180 so that the sprayer assembly 110 can be twisted in a direction opposite installation direction as described above with reference to FIGS. 14-17. In Step 3, the sprayer assembly 110 is detached with a one-quarter turn. In Step 4, the direction of the sprayer assembly 110 is flipped and the sprayer assembly 110 is reattached. In Step 5, the fluid delivery device 108 in the left handed orientation is clipped on a user's vest 205.

INDUSTRIAL APPLICABILITY

The present invention provides a fluid delivery device having a trigger actuated sprayer assembly for dispensing a liquid from a bottle.

Although the invention has been described in considerable detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

What is claimed is:

1. A fluid delivery device comprising:

a bottle for containing a fluid, the bottle having an end wall and a side wall extending away from the end wall, the side wall forming a neck region and terminating at an opening of the bottle;

a body including an attachment ring secured in a bottom opening of the body, the attachment ring including opposed notches, the bottom opening of the body attached to the bottle adjacent the opening of the bottle;

a pump in the body, the pump being in fluid communication with a fluid inlet conduit upstream of the pump and a fluid discharge conduit downstream of the pump, the pump receiving fluid from the fluid inlet conduit and discharging fluid from the fluid discharge conduit, wherein the side wall of the bottle has a concavity that extends from the end wall of the bottle in a direction toward the opening of the bottle; and a clip including a collar, wherein the collar is positioned around the neck region of the bottle adjacent the opening of the bottle, and wherein the collar includes opposed tabs positioned to engage the opposed notches.

2. The fluid delivery device of claim 1 wherein:

a view of a cross-section of the side wall of the bottle transverse to a longitudinal axis of the bottle includes the concavity.

3. The fluid delivery device of claim 1 wherein:

the concavity extends from the end wall of the bottle to the neck region of the side wall of the bottle adjacent the opening of the bottle, the neck region of the side wall being of reduced diameter compared to an end wall region of the side wall of the bottle adjacent the end wall of the bottle.

4. The fluid delivery device of claim 1 wherein:

the fluid discharge conduit extends in a direction transverse to a radius of curvature of the concavity.

5. The fluid delivery device of claim 1 wherein:

the body is attached to the bottle by way of a mounting tab of the attachment ring and the opposed tabs on the clip forming a locking engagement with the opposed notches of the attachment ring.

6. The fluid delivery device of claim 1 wherein:

the clip is arranged in a facing relationship with the concavity in the side wall of the bottle.

7. The fluid delivery device of claim 1 wherein:

the collar contacts a lower end of the body when the body is attached to the bottle.

8. The fluid delivery device of claim 1 wherein:

outer surfaces of the collar and the lower end of the body are flush when the body is attached to the bottle.

9. The fluid delivery device of claim 1 wherein:

the clip includes an inverted J-shaped section integral with the collar.

10. The fluid delivery device of claim 1 wherein:

the attachment ring also includes mounting tabs extending inwardly within the bottom opening adjacent the opposed notches;

the neck region includes a portion that extends above the collar of the clip and includes channels configured to retain the mounting tabs, wherein the body is retained on the neck region of the container by positioning the mounting tabs in the channels by way of a quarter turn and the opposed tabs of the collar engaging the opposed notches of the attachment ring of the body.

11. The fluid delivery device of claim 1 wherein:

a locking engagement of the opposed tabs of the collar within the opposed notches of the attachment ring of the body restrict the orientation of the fluid discharge conduit to one of a first position or a second position, wherein the first position of the fluid discharge conduit is rotated 180 degrees from the second position of the fluid discharge conduit.

12. The fluid delivery device of claim 11 wherein:

the orientation of the body relative to the bottle is a left handed configuration in the first position and a right handed configuration in the second position, and wherein the fluid discharge conduit extends in a direction transverse to a radius of curvature of the concavity in both the first position and the second position.

13. The fluid delivery device of claim 1 wherein:

the body is attached to the bottle by way of a mounting tab of the attachment ring.

14. The fluid delivery device of claim 13 wherein:

the mounting tab is secured in a channel of the neck region of the bottle.

15. The fluid delivery device of claim 14 further comprising:

one of (i) an additional mounting tab or (ii) an additional channel such that the body can be attached to the bottle with the concavity facing leftward or rightward from the body when viewed from a rear view of the body.

* * * * *